US005842391A

United States Patent [19]

Chaconas

[11] Patent Number: 5,842,391

[45] Date of Patent: Dec. 1, 1998

[54] WRENCH WITH RATCHETING ACTION

[76] Inventor: Peter Constantine Chaconas, 4340 Butler Rd., Glyndon, Md. 21071

[21] Appl. No.: 812,514

[22] Filed: Mar. 7, 1997

[51] Int. Cl.[6] ..... B25B 13/46

[52] U.S. Cl. ..... 81/60; 81/58.5

[58] Field of Search ..... 81/58.5, 60, 119

[56] References Cited

U.S. PATENT DOCUMENTS

| | | | |
|---|---|---|---|
| 127,902 | 6/1872 | Leonard . | |
| 161,022 | 3/1875 | Freeman . | |
| 1,191,873 | 7/1916 | Cressey et al. . | |
| 3,349,653 | 10/1967 | Kaufman et al. . | |
| 3,709,073 | 1/1973 | Kurtz | 81/119 |
| 3,838,614 | 10/1974 | O'Donnell . | |
| 3,875,828 | 4/1975 | Evans . | |
| 4,770,071 | 9/1988 | Steier . | |
| 4,796,492 | 1/1989 | Liou . | |
| 4,807,500 | 2/1989 | Main . | |
| 4,889,020 | 12/1989 | Baker . | |
| 4,991,468 | 2/1991 | Lee . | |
| 5,197,358 | 3/1993 | Hsu . | |
| 5,454,283 | 10/1995 | Stefano . | |
| 5,467,672 | 11/1995 | Ashby . | |
| 5,653,151 | 8/1997 | Blacklock | 81/60 |
| 5,709,137 | 1/1998 | Blacklock | 81/60 X |

*Primary Examiner*—James G. Smith
*Attorney, Agent, or Firm*—Leonard Bloom

[57] ABSTRACT

A ratchet wrench having a handle and an integral head. The head has a chamber formed therein with a wall about the chamber. At least one tooth is formed on the wall and projects into the chamber. A cylindrical rotor having a plurality of axial teeth is disposed in the chamber. The chamber is non circular and has a cross-sectional area greater than the cross-sectional area of the rotor wherein the rotor is translatably and eccentrically movable within the chamber. Movement of the handle engages a portion of the teeth on the rotor in locked driving engagement with the wall of the chamber and the at least one tooth on the wall of the chamber. Backswinging the handle disengages the rotor. Three embodiments are disclosed. Methods of use of the three embodiments are disclosed.

35 Claims, 21 Drawing Sheets

WRENCH WITH RATCHETING ACTION

BACKGROUND OF THE INVENTION

The present invention relates to a wrench and more particularly, to a wrench which is pawl-less and has ratcheting action.

There are many types of ratchet wrenches which are commercially available and many more which are disclosed in patents. With very few exceptions, the ratchet wrenches include a pawl to ratchet with teeth on a ratchet gear which is retained within an opening in the head of the wrench.

U.S. Pat. No. 1,191,873 to Cressey et al disclose an automatic tool having a ratchet mechanism with a ratchet wheel. There is an aperture in the ratchet wheel in which the end of a work tool is mounted. Two pawls are adapted to engage the ratchet wheel as the outer casing is shifted from one side to the other. A coiled spring is seated in a respective recess to bear against the respective pawl. Thus, the tool has pawls and does not have a ratchet gear capable of independent eccentric movement within an opening in the head of a tool.

U.S. Pat. No. 3,349,653 to Kaufman et al disclose a ratchet spanner which has a circular bore in which there is disposed a drum-like member. The drum-like member has an aperture in the center to receive a fastener and has a plurality of teeth around the outer circumference. A recess contains a pawl urged to engage the teeth by a spring. U.S. Pat. No. 3,838,614 to O'Donnell discloses a ratchet wrench capable of clockwise and counter-clockwise operation. The ratchet gear is seated within the head and is capable of rotation in both directions. A ratchet locking mechanism includes a compression spring within the elongated compartment and the double tooth dog. When the compression spring is fully extended, the dog moves towards the ratchet gear. The teeth of the dog then constitute a teethed portion of the otherwise smooth-walled cavity in the head wherein the ratchet gear is accommodated. The lesser tooth of the dog is securely locked flush with the tooth of the ratchet gear and is reinforced by the locking of the greater tooth against the next preceding tooth of the ratchet gear. The holding teeth are not, however, integral with the smooth-walled cavity in the head. The smooth-walled cavity is not bigger than the ratchet gear, therefore, the ratchet gear is not capable of being moved between "locking" and "free-rotation" positions within the cavity.

In U.S. Pat. No. 4,796,492, Lieu discloses a clutch-type socket wrench having a handle connected to a hollow head. Two pairs of diametrically-opposed teeth are formed annularly within the hollow head. An annular groove extends circumferentially about the inside of the head and passes through each of the teeth. The teeth decrease in height from groove toward the ends of the hollow head. A socket is disposed in the head. The socket has a plurality of axially elongated teeth formed thereon. An annular groove is formed in the teeth on the socket. A C-shaped locking ring is disposed in groove in the socket and, when the socket is inserted in the hollow head, the locking ring extends partially into the annular groove about the head. The torque transmitting socket member is inoperative when the handle is perpendicular to the axis of the socket member. Moving the handle upwardly or downwardly engages the teeth on the socket member with the teeth in the head and transmits torque from the handle to the socket.

Lee, in U.S. Pat. No. 4,991,468, discloses a ratchet wrench having a ratchet gear seated within a smooth-walled chamber. A pawl with ratcheting teeth is mounted within a lateral hole communicating with the chamber to allow clockwise or counterclockwise rotation of the ratchet gear. There is no eccentric or transverse movement of the ratchet gear within the chamber.

Stefano, in U.S. Pat. No. 5,454,283, discloses an open-end ratchet wrench with a U-shaped ratchet gear having teeth reciprocally engageable with non-rotatable dog gear having interlocking teeth. The dog gear is held in place by the spring, which keeps pressure upon the dog gear engageable with the ratchet gear. The ratchet gear does not move transversely within the chamber.

Baker, in U.S. Pat. No. 4,889,020, discloses an open end ratchet wrench in which the user moves the wrench in a forward and downward manner followed by a reversal of direction of movement.

BRIEF SUMMARY OF THE INVENTION

It is an object of the present invention to provide a wrench with ratcheting action which is manufactured at low cost with minimum components and is easy to use.

In accordance with the teachings of the present invention, there is disclosed a wrench having a handle and an integral head. The head has a top surface, a bottom surface and a chamber formed therein. The chamber has a wall thereabout. At least one tooth is formed on the wall of the chamber which projects into the chamber. A cylindrical rotor is disposed in the chamber. The rotor has a plurality of spaced-apart teeth formed axially on a circumference thereof. The rotor has means thereon to engage a workpiece. The chamber in the head has a cross-sectional area and the rotor has a smaller cross-sectional area, such that the rotor is translatably and eccentrically moveable within the chamber in the head. Movement of the handle in a first direction engages the at least one tooth in the chamber with one of the teeth on the rotor and transmits torque to the rotor and the means to engage the workpiece. Movement of the handle in a second opposite direction disengages the teeth and moves the rotor from engagement with the at least one tooth on the chamber wall.

There is further disclosed a wrench having a handle and an integral head, the head having a chamber formed therein. The chamber has a wall thereabout. A first set of teeth are formed on the wall of the chamber and project into the chamber. A second set of teeth are formed on the wall of the chamber and are spaced apart from the first set of teeth. The second set of teeth project into the chamber. A cylindrical rotor is disposed in the chamber. The rotor has a plurality of spaced-apart teeth formed axially on a circumference thereof. A workpiece engagement means is formed on the rotor. The chamber in the head has a cross-sectional area and the rotor has a smaller cross-sectional area, such that the rotor is translatably and eccentrically moveable within the chamber in the head. Movement of the handle engages one of the sets of teeth on the chamber wall with corresponding teeth on the rotor and abuts the other set of teeth on the chamber wall with corresponding teeth on the rotor such that the teeth on the rotor are in locked driving engagement with the teeth on the wall of the chamber. Reverse movement of the handle moves the head with respect to the rotor, disengaging the teeth on the rotor from the one set of teeth on the chamber wall in the head.

Additionally, there is disclosed a wrench comprising a handle and an integral head, the head having a chamber formed therein. The chamber has a wall thereabout. At least a first tooth is formed on the wall of the chamber and projects into the chamber. At least a second tooth is formed on the wall of the chamber and is spaced apart from the first tooth. The at least a second tooth projects into the chamber. A cylindrical rotor is disposed in the chamber. The rotor has a plurality of spaced-apart teeth formed axially on a circumference thereof. A workpiece engaging means is formed on the rotor. The chamber in the head has a cross-sectional area and the rotor has a smaller cross-sectional area, such that the rotor is translatably and eccentrically moveable within the chamber in the head. Blocking means are movably attached to the head, wherein when the head is moved with respect to the rotor such that selected teeth on the rotor are in driving engagement with a selected at least one tooth on the wall of the chamber, the at least one spaced-apart tooth on the wall of the chamber abuts a corresponding tooth on the rotor. Movement of the blocking means to a selected position moves the blocking means to a position adjacent to the abutted at least one tooth on the wall of the chamber, thereby preventing the abutted at least one tooth on the wall of the chamber from becoming engaged with the teeth on the rotor.

In yet another aspect there is disclosed methods of use of the above described wrenches in a ratcheting manner.

These and other objects of the present invention will become apparent from a reading of the following specification taken in conjunction with the enclosed drawings.

DESCRIPTION

Figure 1:
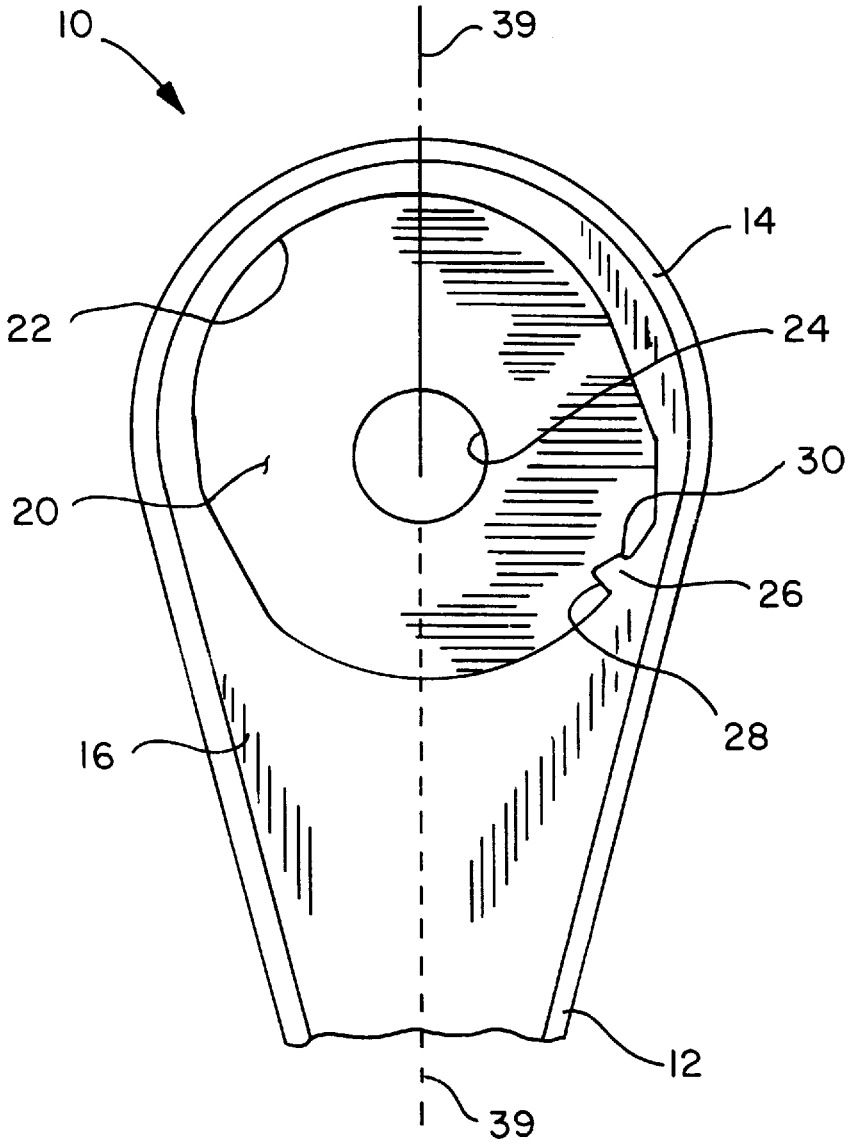
FIG. 1 is a top plan view of the head of one embodiment of the wrench of the present invention showing the chamber in the head and one tooth formed on the wall of the chamber.

Referring now to FIGS. 1–7, a first embodiment of the pawl-less wrench 10 of the present invention has a handle 12 and integral head 14. The head 14 has a top surface 16, a bottom surface 18 and a chamber 20 formed therein from the top surface 16 of the head 14. The chamber 20 has a wall 22 formed thereabout. An opening 24 is formed in the bottom surface 18 of the head 14, the opening 24 communicating with the chamber 20. At least one tooth 26 is formed on the wall 22 such that the tooth 26 projects into the chamber 20. The tooth 26 has a first surface 28 which has a height and a second opposite surface 30 which has a height less than the height of the first surface 28. A cylindrical rotor 32 is disposed in the chamber 20. The rotor 32 has a plurality of spaced-apart teeth 34 formed axially about the circumference of the rotor 32. Preferably, all of the teeth 34 are spaced apart by an equal distance and all have a top land 44 of the same length. The rotor 32 has means 36 thereon to receive an accessory to engage a workpiece (not shown). The means 36 may be a tang 36 formed on the rotor 32. Preferably, two tangs are formed on opposite ends of the rotor 32 (FIGS. 5 and 6) such that when the rotor is disposed in the chamber 20, one tang 36 extends outwardly from the top surface 16 of the head 14 and the other tang 36 extends through the opening 24 and outwardly from the bottom surface 18 of the head 14. Alternately, the means on the rotor 32 is an opening 36 formed, preferably axially in the center of the rotor. The inner surface of the opening 36 is adapted to receive an accessory or to receive the head of a fastener. The tang or opening thereby is operable from the top or the bottom of the wrench as will be discussed.

The chamber 20 has a cross-sectional area and the rotor 32 has a smaller cross-sectional area. Thus, the rotor 32, when disposed in the chamber 20, is translatably and eccentrically moveable within the chamber 20. The rotor 32 may move in any planar direction within the chamber 20.

Preferably, the chamber 20 is non-circular. A flat portion 38 is formed on wall 22 of the chamber spaced apart from the tooth 26 formed on the wall 22 of the chamber 20. The chamber has a length preferably along a longitudinal center line 39 of the wrench and a width perpendicular to the length. The length is greater than the width.

The teeth 34 on the rotor 32 each have a first surface 40 and a second surface 42 which are of equal height. It is preferred that the top of the land 44 be flat to provide the maximum contact with the flat portion 38 of the wall 22 as of the chamber 20, as will be described. The distance between the teeth 34 on the rotor 32 is greater than the height of the surface 40, 42 of the teeth 34 on the rotor and is also greater than the height of the first surface 28 of the tooth 26 on the wall 22 of the chamber 20. The height of the first surface 28 of the tooth 26 on the wall 22 of the chamber is greater than the height of the surface 40, 42 of the teeth 34 on the rotor 32.

Means are disposed in the top surface 16 of the head 14 to substantially cover the chamber 20 to retain therein the rotor 32 and to prevent dirt and dust from entering the chamber 20. Preferably the means is a cover plate 46 with an opening therein to receive the tang 36 or permit access to the opening 36 in the rotor. Means such as a retaining ring 48 or screws secure the cover plate 46 to the head 14. Similarly, it is preferred that a cover plate with an opening and a retaining ring be disposed on the bottom surface 18 of the head 14. The opening in the cover plates must be large enough to receive the respective tang as the rotor 32 moves eccentrically within the chamber 20.

Figure 2:
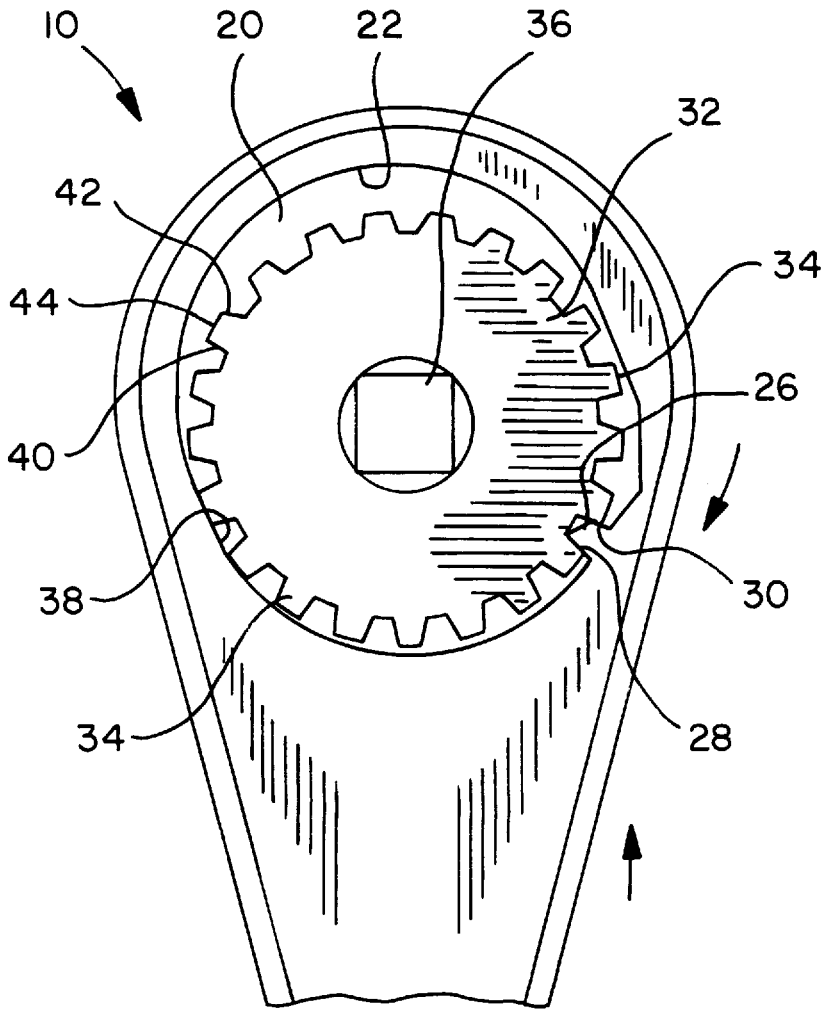
FIG. 2 is a top plan view as in FIG. 1 further showing the rotor in the chamber engaging the tooth on the side wall in the chamber.
Figure 3:
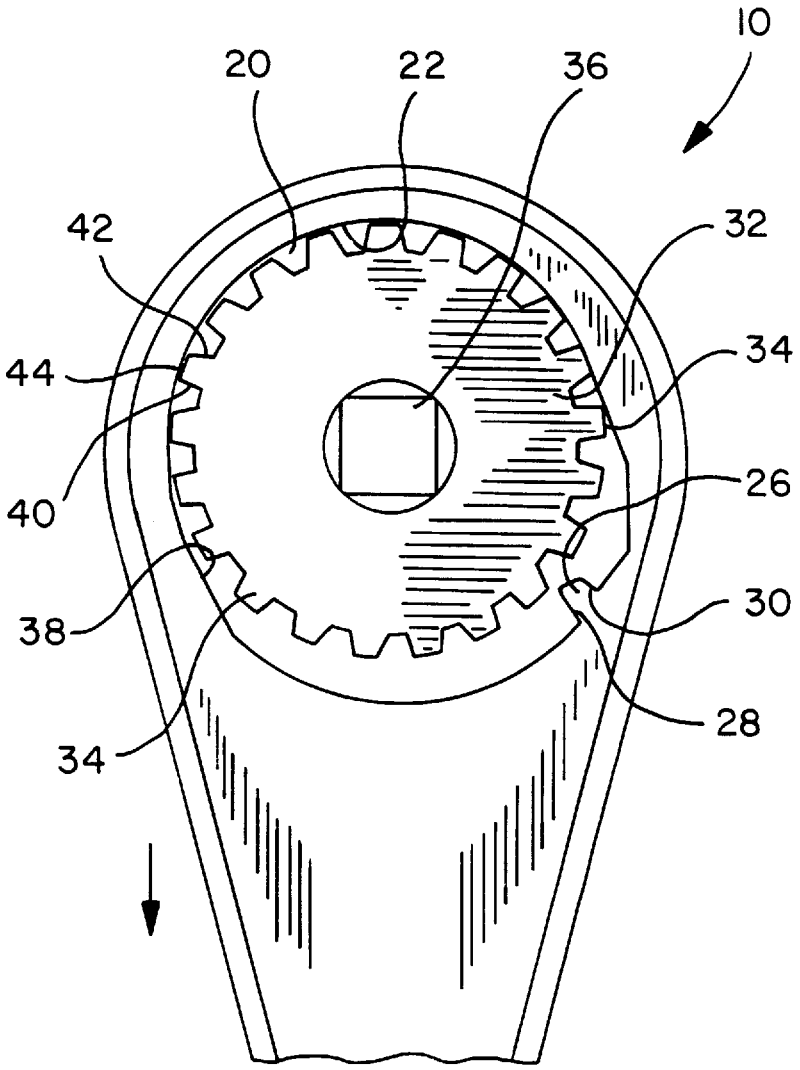
FIG. 3 is a top plan view as in FIG. 1 further showing the rotor in the chamber disengaged from the tooth on the side wall in the chamber.
Figure 4:
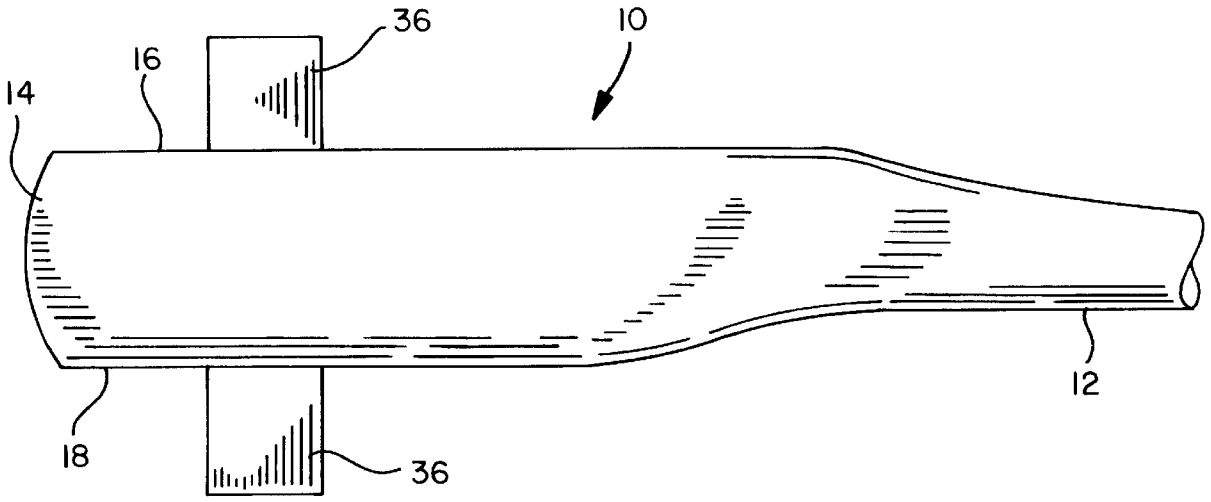
FIG. 4 is a side elevation view of one embodiment of the wrench.
Figure 5:
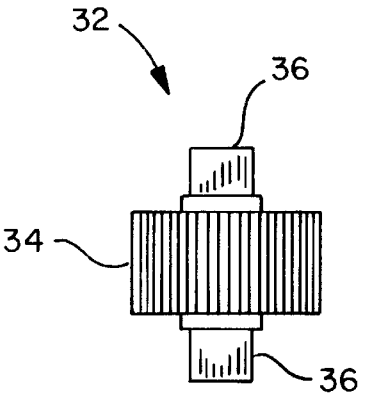
FIG. 5 is a side elevation view of the rotor of the embodiment of FIG. 4.
Figure 6:
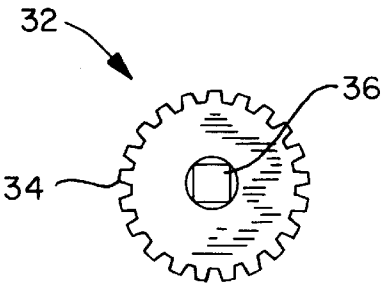
FIG. 6 is a top plan view of the rotor of FIG. 5.
Figure 7:
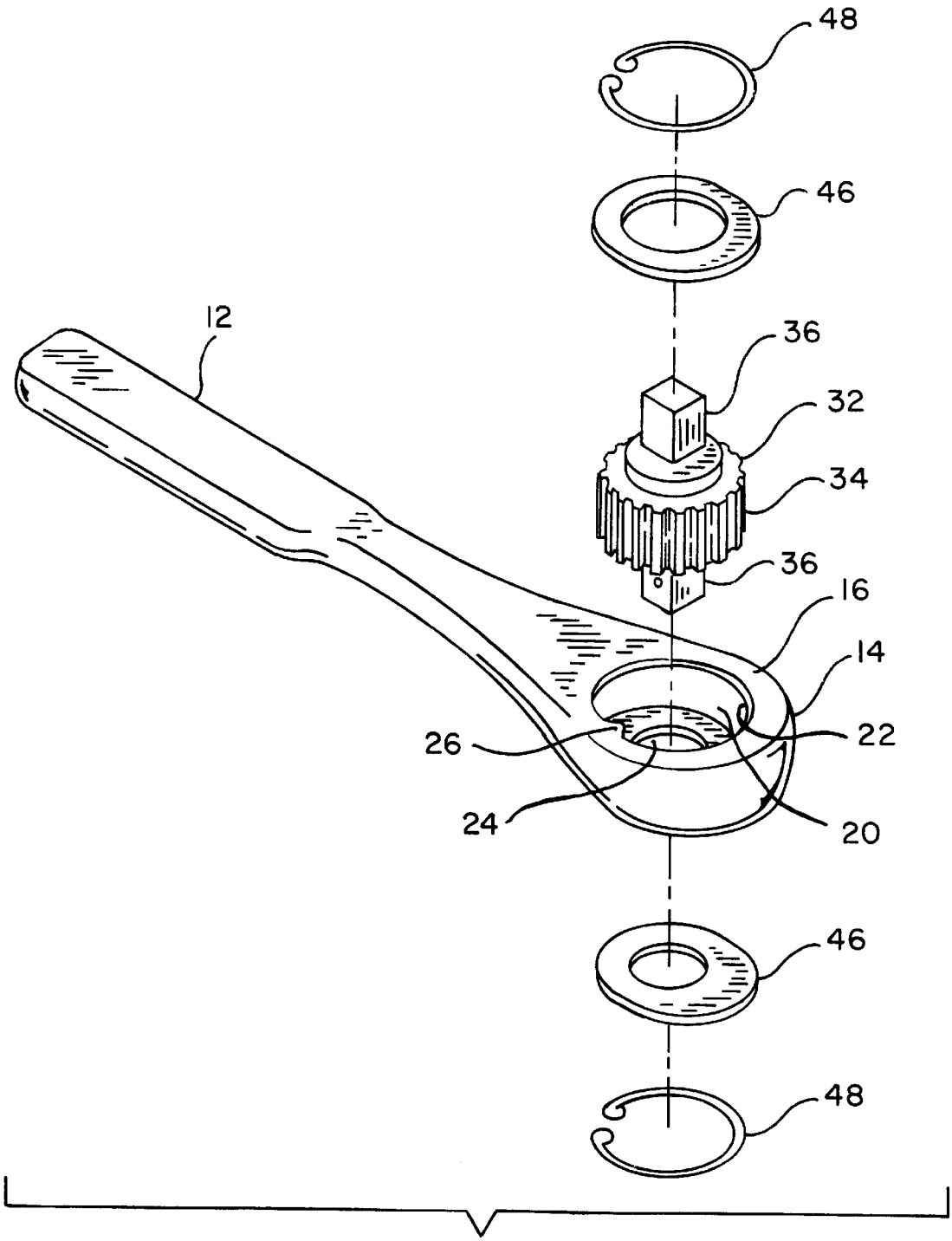
FIG. 7 is an exploded perspective view of the wrench of the one embodiment.

The wrench of the first embodiment is used by connecting an accessory to the means 36 (e.g., tang) or connecting directly to the workpiece engaging means on the rotor 32 and holding the wrench such that the accessory or engaging means engages the workpiece to apply torque in a first direction (e.g., clockwise or counterclockwise as desired). The handle 12 of the wrench 10 is moved in a first longitudinal direction toward the workpiece such that the first surface 28 of the tooth 26 on the wall 22 of the chamber 20 engages an surface of one of the teeth 34 on the rotor 32 (FIG. 2). The top land 44 of the engaged tooth 34 on the rotor 32 does not contact the wall 22 of the chamber 22 because the height of the first surface 28 of the tooth 26 on the wall is greater than the height of the surfaces 40, 42 of the teeth 34 on the rotor. The longitudinal movement of the handle 12 simultaneously causes the top land 44 of another tooth 34 on the rotor 32 to contact the flat portion 38 of the wall 22 of the chamber 20. The handle 12 is rotated in a first lateral direction such that the tooth 26 in the chamber exerts force against the engaged tooth 34 on the rotor 32 and also forces the other tooth 34 on the rotor 32 against the flat portion 38 to further exert force against the rotor 32. These forces are transmitted through the means 36 to receive the accessory (e.g., tang or axial opening), and through the accessory to drive the workpiece. The handle 12 is rotated laterally to the extent possible within available space and is backswung in a second lateral direction opposite to the driving direction. The rotor 32 translates within the chamber 30 and the tooth 26 on the wall disengages from the teeth 34 on the rotor (FIG. 3). As the handle rotates laterally in the second direction, the handle also moves longitudinally in a second opposite direction away from the workpiece. The handle is then moved toward the workpiece as previously described and the tooth 26 on the wall re-engages one of the teeth in the rotor. The above steps are repeated in a ratcheting manner.

The first embodiment is unidirectional; force can be transmitted only in a first direction (for example, clockwise). In order to apply force to the workpiece in a second opposite direction (for example, counterclockwise), the wrench 10 is inverted and the accessory is connected to the accessory receiving means 36 (e.g., tang) on the opposite side of the wrench. Thus, if the accessory is connected to the means from the bottom surface of the wrench for clockwise rotation, the accessory is reconnected to the means from the top surface of the wrench for counterclockwise rotation. The steps as performed above are repeated except that after the handle is moved longitudinally toward the workpiece, the handle is then rotated in the second opposite lateral direction to exert force on the workpiece. The backswing is in the first lateral direction. Ratcheting is performed by sequential movement of the handle.

Figure 12:
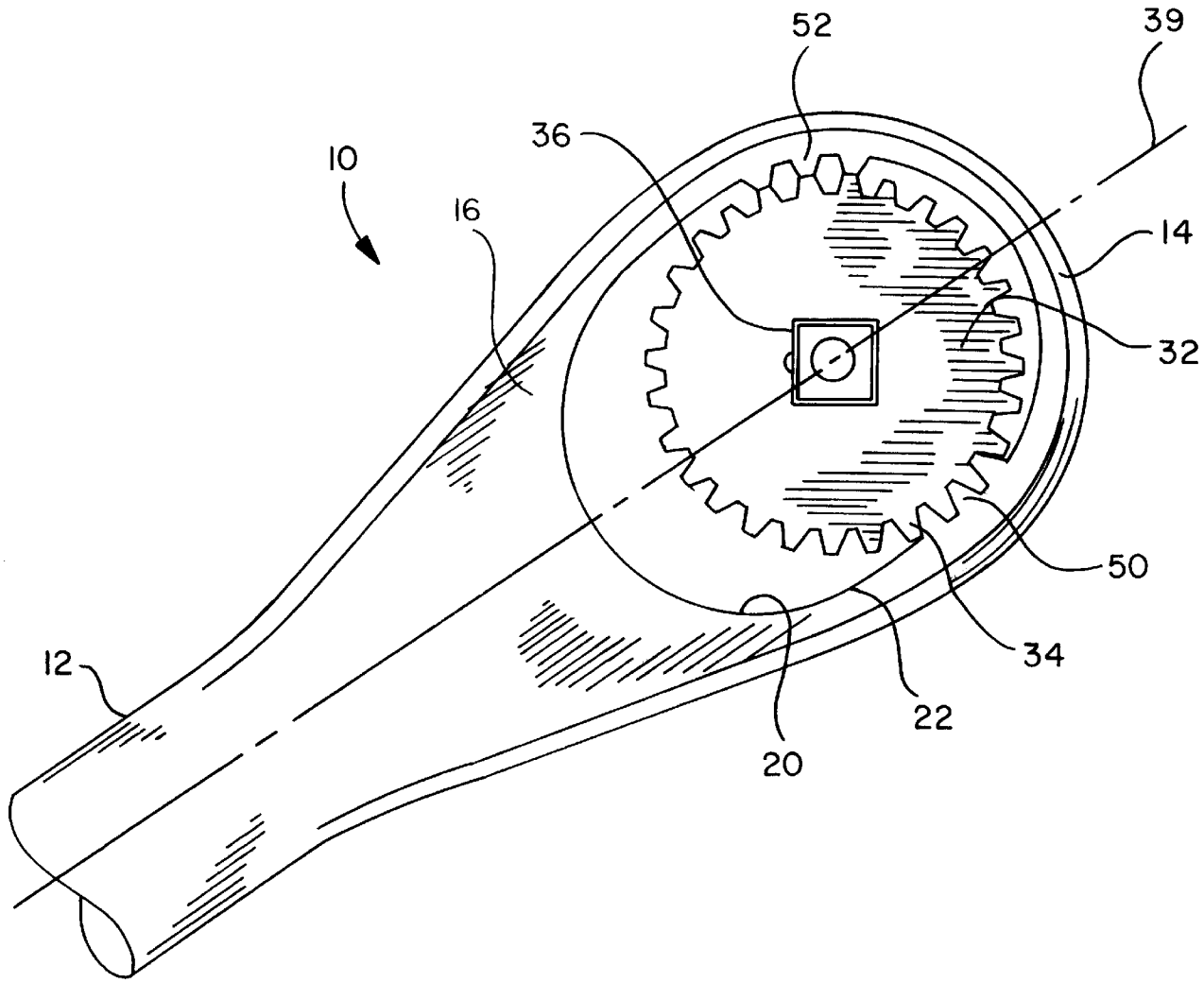
FIG. 12 is a top plan view of a variation of the embodiment of FIG. 8 in which the teeth on the wall of the chamber are distal from the handle.
Figure 13:
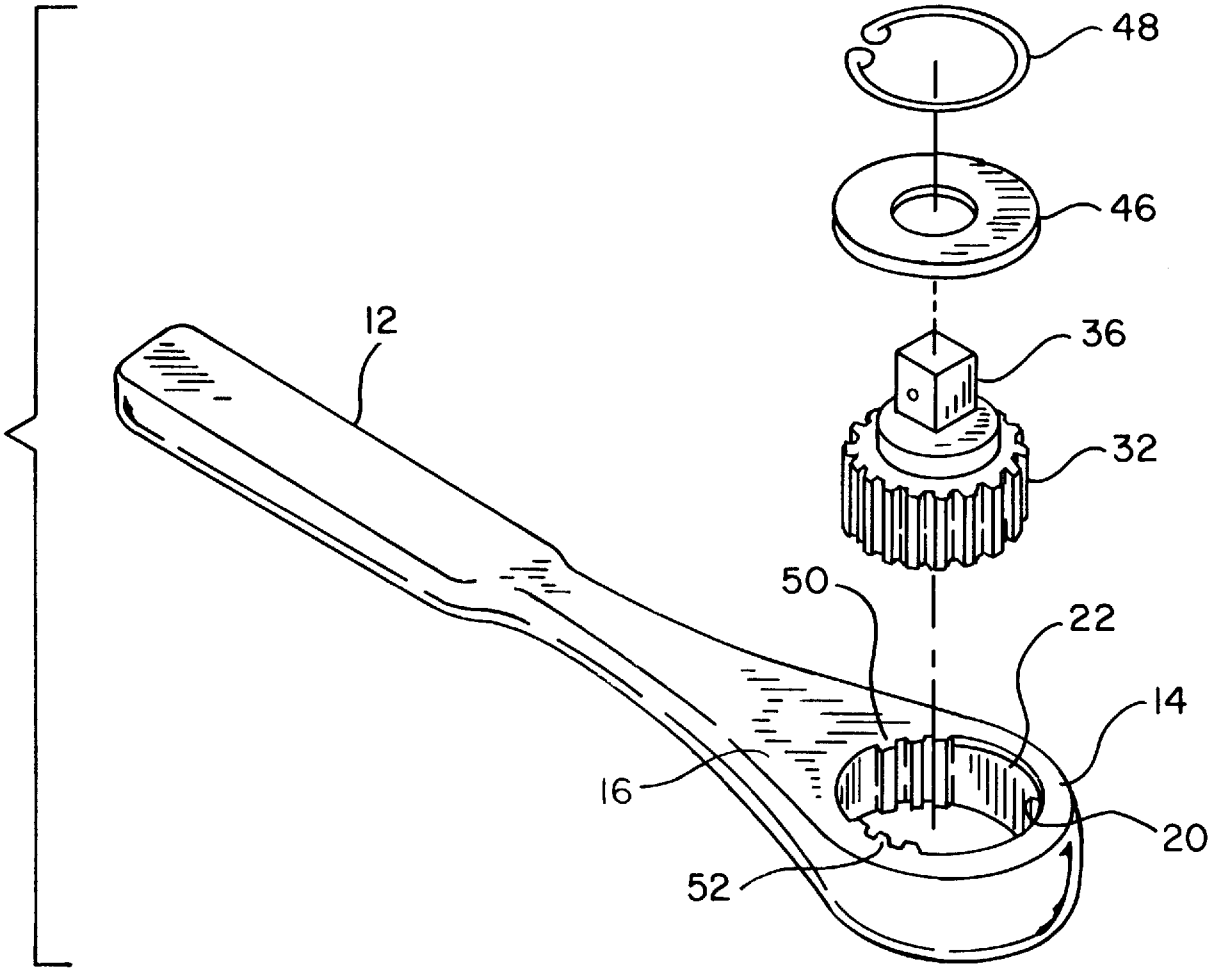
FIG. 13 is an exploded perspective view of the wrench of the second embodiment.

A second embodiment of the pawl-less ratchet wrench is shown in FIGS. 8–13. The wrench 10 has a handle 12, an integral head 14, a top surface 16, a bottom surface 18 and a chamber 20 with a wall 22 formed thereabout. The chamber 20 is formed from the bottom surface 18 of the head, but differs from the first embodiment in that there is no opening formed in the opposite surface 16 of the head 14 communicating with the chamber 20. Also, the chamber 20 has a first set of teeth 50 and a second set of teeth 52 formed on the wall 22 of the chamber 20 and projecting into the chamber 20. The sets of teeth 50, 52 are spaced apart from each other. Each set includes at least one tooth and preferably includes three teeth. The sets of teeth 50, 52 are opposite from one another on the wall 22 of the chamber 20 and may be proximal to the handle (FIG. 8) or distal from the handle (FIG. 12). The teeth 26 in any one set 50, 52 are equidistant from one another. The chamber 22 is non-circular having a length, preferably along the center line 39 of the wrench, and a width perpendicular to the length. The length is greater than the width. The rotor 32 has a plurality of spaced-apart teeth 34 formed axially about the circumference of the rotor 32. The teeth 34 on the rotor 32 are spaced apart by an equal distance and are of the same size with respect to height and the length of the top land 44. The teeth 34 on the rotor 32 are approximately the same height and width as the teeth 26 of the sets 50, 52. The rotor 32 has a means 36 formed thereon to receive an accessory or to directly engage a workpiece (not shown). Preferably the means is a tang at the axial center of the rotor. The tang 36 projects outwardly from the bottom surface 18 of the head.

The chamber 20 has a cross-sectional area and the rotor 32 has a smaller cross-sectional area. The rotor 32, when disposed in the chamber 20, is translatably and eccentrically moveable within the chamber 20.

Means are disposed on the bottom surface 18 of the head to retain the rotor 32 in the chamber 20 and to cover the chamber 20 to prevent dirt and dust from entering the chamber 20. Preferably, the means is a cover plate 46 with an opening therein to receive the tang 36 or to receive the workpiece. A retaining ring 48 or screws (not shown) secure the cover plate 46 to the head. The opening in the cover plate 46 is sufficiently large to receive the tang as the rotor 32 moves eccentrically within the chamber 20.

Figure 8:
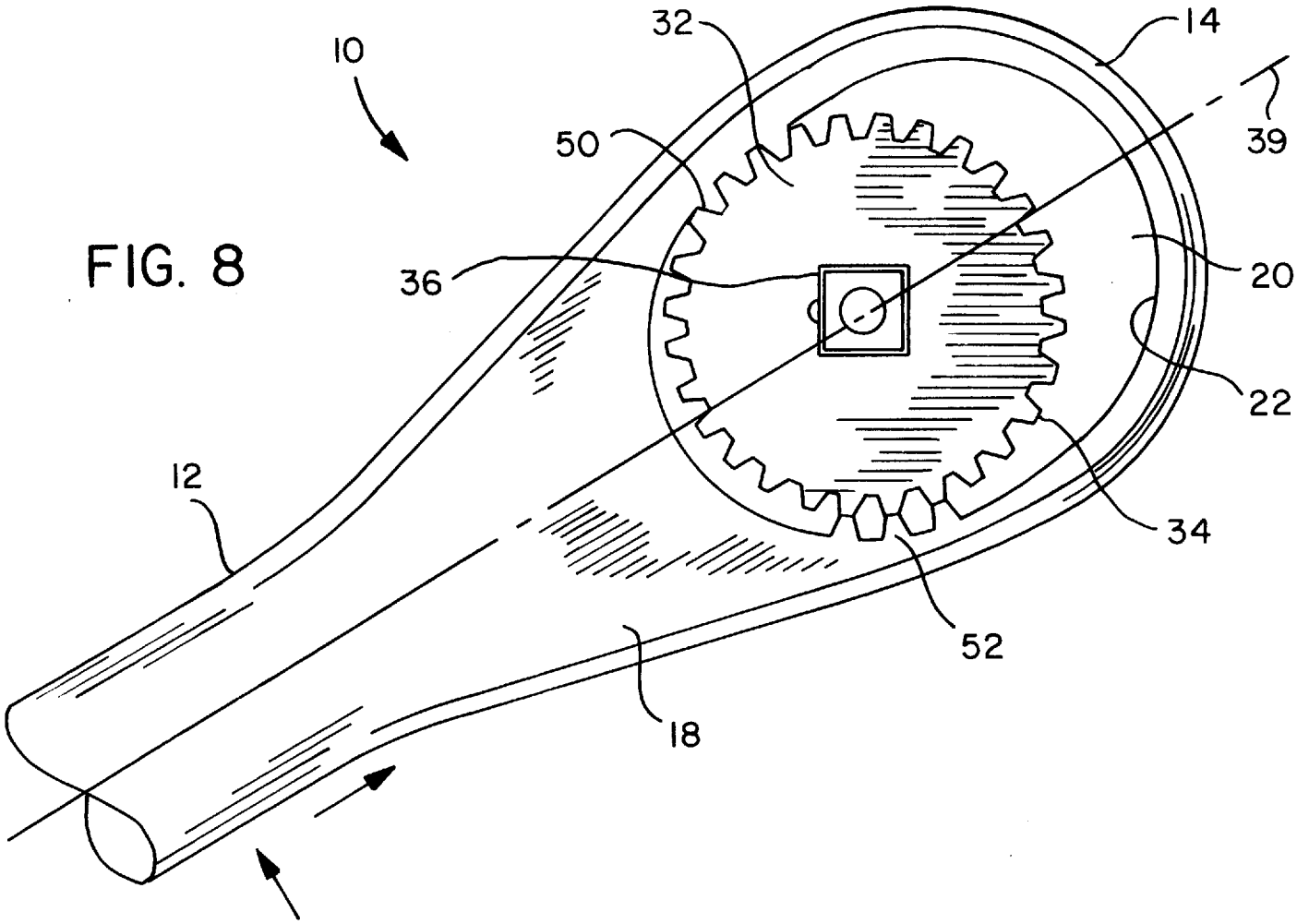
FIG. 8 is a top plan view of a second embodiment of the wrench of the present invention showing the rotor in the chamber engaging one set of teeth on the side wall in the chamber.
Figure 9:
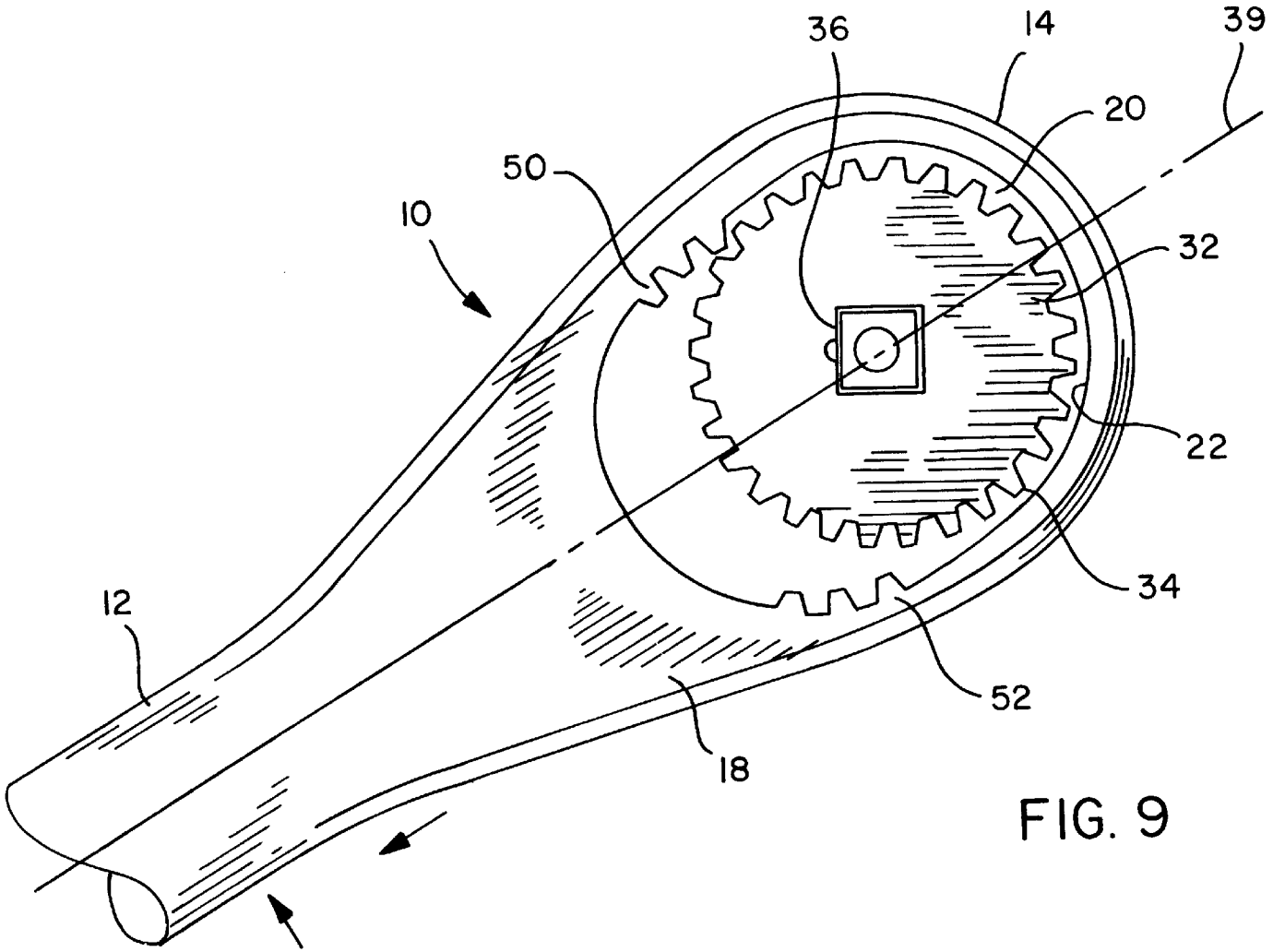
FIG. 9 is a top plan view of the embodiment of FIG. 8 showing the rotor disengaged from the set of teeth on the side wall in the chamber.

The wrench 10 of the second embodiment is used by connecting an accessory to the means 36 (e.g., the tang) on the rotor 32 and holding the wrench so that the accessory engages the workpiece. The handle 12 is moved in a first longitudinal direction to engage the first set of teeth 50 in the chamber 20 with corresponding teeth 34 on the rotor 32. The top land on the second set of teeth 52 in the chamber 20 abut the top lands 44 of corresponding teeth on the rotor 32. In this manner, the rotor 32 is held in locked driving engagement with the head 14 of the wrench 10 (FIGS. 8 and 12). In the alternative in which the sets of teeth 50, 52 in the chamber are proximal to the handle, the first longitudinal direction is toward the workpiece. In the alternative in which the sets of teeth 50, 52 in the chamber are distal from the handle, the first longitudinal direction is away from the workpiece. The handle 12 is rotated laterally in a first rotational direction wherein torque is transmitted through the engaged and abutted teeth to the rotor, the tang on the rotor, the accessory and to the workpiece. The handle 12 is rotated laterally to the maximum extent and is then backswung in a second opposite rotational direction and simultaneously in a second opposite longitudinal direction such that the rotor translates in the larger chamber 20 and the teeth 34 on the rotor disengage from the sets of teeth 50, 52 in the chamber 20 (FIG. 9). The handle 12 is then moved in the first longitudinal direction to re-engage the teeth 34 on the rotor 32 with the first set of teeth 50 in the chamber. This sequence is repeated in a ratcheting manner.

Figure 10:
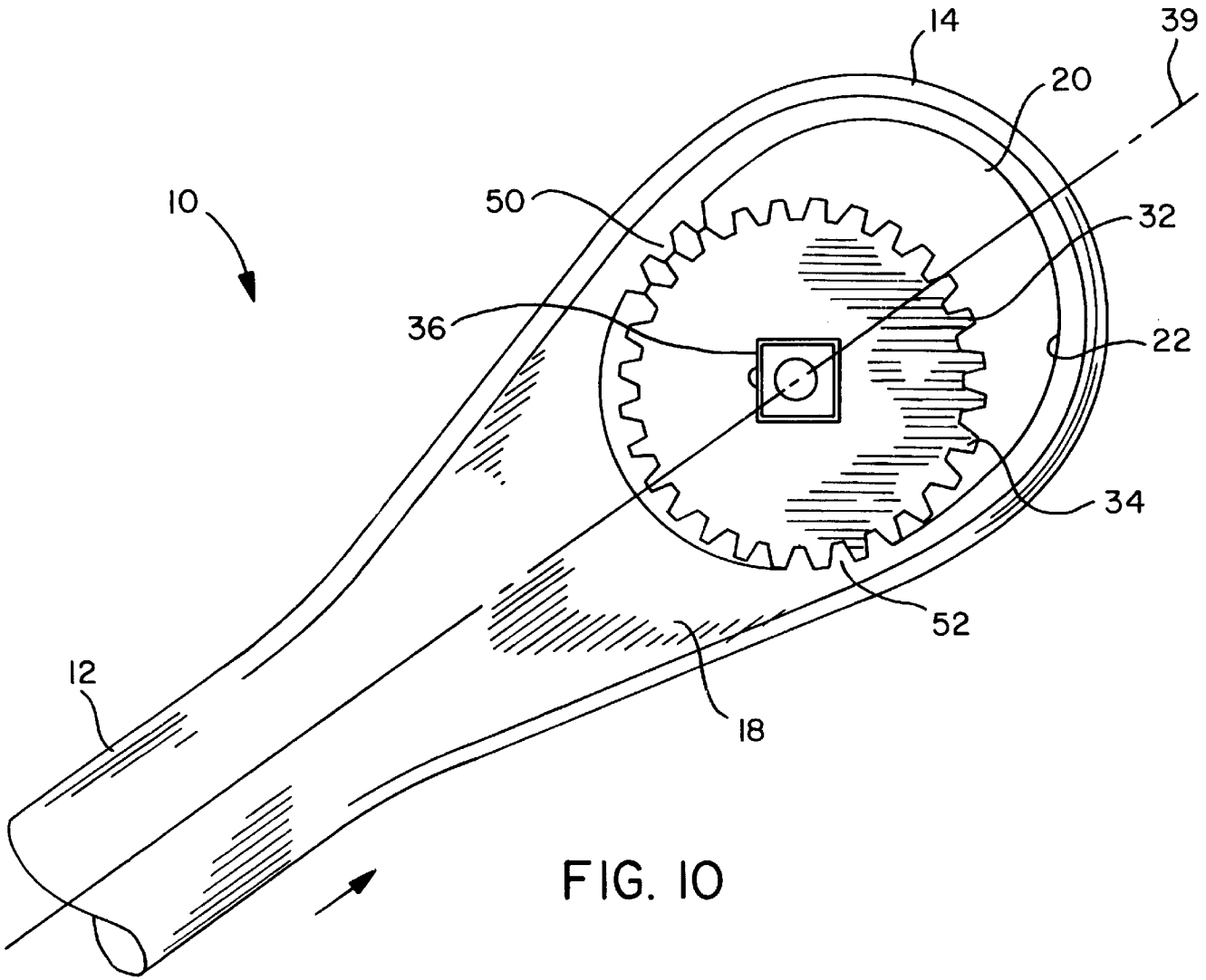
FIG. 10 is a top plan view of the embodiment of FIG. 8 showing the rotor engaged with the second set of teeth in the side wall in the chamber.
Figure 11:
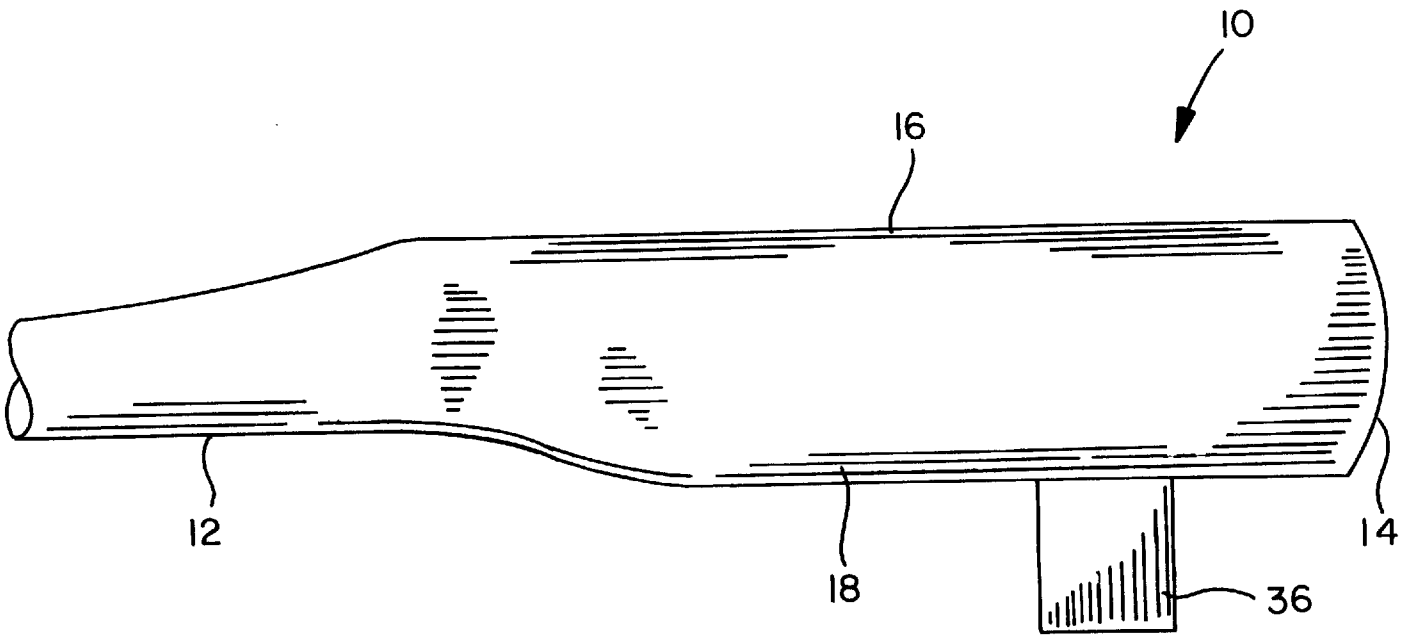
FIG. 11 is a side elevation view of the embodiment of FIG. 8.

In order to apply torque to the workpiece in a second opposite direction (such as to loosen a fastener as contrasted to tightening the fastener), the handle 12 is moved in the first longitudinal direction to engage the second set of teeth 52 in the chamber 20 with corresponding teeth 34 on the rotor 32 and abut the lands on the first set of teeth 50 with the land 44 on corresponding teeth 34 on the rotor 32 (FIG. 10). The handle 12 is moved laterally in the second rotational direction whereby torque is transmitted to the rotor, through the tang and accessory to the workpiece. The handle 12 is moved laterally to the maximum possible extent and is backswung in the first rotational direction and in the second longitudinal direction, thereby disengaging the teeth on the rotor from the sets of teeth in the chamber. The handle is again moved in the first longitudinal direction as before and the steps are repeated in a ratcheting manner.

The third embodiment of the wrench is shown in FIGS. 14–25. The wrench has a handle 12, an integral head 14, a top surface 16, a bottom surface 18 and a chamber 20 formed from the top surface 16 with a wall 22 about the chamber 20. There is an opening 24 formed in the bottom surface 18 communicating with the chamber 20. The chamber 20 has at least a first tooth 54 formed on the wall 22 on a side of the chamber 20 and at least a second tooth 56 formed on the wall 22 on an opposite side of the chamber 20. The teeth 54, 56 are spaced apart from one another and project into the chamber 20. The teeth 54, 56 are disposed in the chamber 20 proximal to the handle 12. The teeth 54, 56 distal from the handle are identical in size each having the same height. Teeth proximal to the handle have a height less than those most distal from the handle. Spacing between the teeth is equal. The chamber 20 is non-circular having a length, preferably along the center line 39 of the wrench, and a width perpendicular to the length. The length is greater than the width. The wall 22 of the chamber 20 proximal to the handle 12 and between the teeth 54, 56 on the wall, has two spaced-apart non-arcuate portions 58, 60 formed thereon. The non-arcuate portions 58, 60 are formed between the teeth 54, 56 on the chamber wall 22. The non-arcuate portions 58, 60 are separated from each other by two arcuate portions 59, 61 which are adjoining one another.

A cylindrical rotor 32 is disposed in the chamber 20. The rotor 32 has a plurality of spaced-apart teeth 34 formed axially about the circumference of the rotor 32. The teeth 34 on the rotor 32 are all spaced apart by an equal distance, and all are of the same size with respect to height of the respective teeth and the length of the top land 44. The height of the teeth 54, 56 on the wall 22 of the chamber 20 are greater than the height of the teeth 34 on the rotor. Preferably, the axial length of the rotor 32 and the teeth 34 thereon, is greater than the axial length of the teeth 54, 56 on the wall of the chamber 20 such that, when the rotor 32 is disposed in the chamber 20, a portion of the rotor 32 with the teeth 34 thereon, extends above a portion of the head 14. The rotor 32 has a means 36 formed thereon to engage a workpiece (not shown) or to receive an accessory. Preferably, the means is a tang 36 at the axial center of the rotor 32. The tang 36 projects outwardly through the opening 24 and from the bottom surface 18 of the wrench 10. A quick release mechanism 62 may be disposed in the rotor 32 to permit the quick release of an accessory carried by the tang 36. Means are disposed on the top portion of the chamber in the head to retain the rotor 32 in the chamber 20 and to cover the chamber to prevent dirt and dust from entering the chamber. Preferably the means is a cover plate 46 with an opening therein to receive the quick release mechanism 62. A retaining ring 48 or screws (not shown) secure the cover plate 46 to the head.

The chamber 20 has a cross-sectional area and the rotor 32 has a smaller cross-sectional area. The rotor 32, when disposed in the chamber 20 is translatable and eccentrically moveable within the chamber 20.

In one embodiment, a blocking means 64 is pivotally attached to the head 14 near the chamber 20 and proximal to the handle 12. The blocking means 64 has a center stem 66 and a pair of spaced-apart arms 68. Each arm 68 has a respective end 70. Biasing means 72 are disposed in the wrench 10 in a manner to be in contact with the center stem 66 to retain the center blocking means 64 in a selected pivotal position. Preferably, a blind bore 74 is formed in the head 14 of the wrench near the chamber 20 and a detent means 76 such as a spring and ball are disposed in the bore 74. The detent means 76 is urged against the blocking means 64, and preferably against the center stem 66 on the blocking means 64. In this manner, the blocking means 64 is pivoted to a desired position, as will be described, and is prevented from moving by the biasing means 72. The blocking means 64 may be pivotally mounted on a portion of the top surface 16 of the head 14 such that the end 70 of the arm 68 abuts, or otherwise blocks, at least one tooth 34 on the rotor 32. In this configuration (FIG. 17), the axial length of the rotor 32 is greater than the axial length of the chamber 20 and the rotor 32 extends above the portion of the top surface 16 on which the lever 64 is mounted. Alternately, the blocking means 64 may be pivotally mounted in a depressed portion of the top surface 16 of the head 14 so that the end 70 of the arm 68 abuts at least one tooth 34 on the rotor 32 (FIG. 18). In this configuration, the axial length of the rotor 32 is approximately equal to the axial length of the wall 22 of the chamber 20.

In a second embodiment of the blocking means 64 (FIGS. 20–25), a sleeve member 78 is disposed in the chamber 20 peripherally adjacent to the wall 22 of the chamber 20 distal from the handle 12. The sleeve member 78, preferably extends approximately the height of the chamber wall 22. The sleeve member 78 has a shifting means, preferably a lever 80. The lever 80 extends outwardly toward the handle 12 of the wrench 10. Preferably, the end of the lever 80 near the handle 12 has a vertically upstanding portion to enable the user to more easily move the lever 80. The sleeve member 78 extends circumferential around approximately one-half of the chamber 20. The shifting means may be a knurled surface formed on an upper edge of the sleeve member. The sleeve member 78 has opposite ends 82. The sleeve member 78 also is formed with at least one, and preferably two spaced-apart notches, grooves or dimples 86 formed therein. Preferably, the notches 86 are opposite from the lever but may, alternately be formed on any portion of the sleeve member 78. At least one cooperating protrusion 88 is formed on the wall 22 of the chamber 20.

The wrench 10 of the third embodiment is used by connecting the accessory to the means 36 (e.g., the tang) on the rotor 32 and holding the wrench 10 so that the accessory engages the workpiece. The handle 12 is moved in a first longitudinal direction toward the workpiece to engage the first tooth 54 on the chamber wall 22 with corresponding teeth 34 on the rotor 32. The land 57 on the second tooth 56 on the chamber wall 22 abuts the top land 44 of other corresponding teeth 34 on the rotor 32. The top land of at least one tooth 34 on the rotor 32 contacts one of the arcuate portions 59, 61 of the chamber 20 between the non-arcuate portions 58, 60. This contact prevents the teeth 34 on the rotor 32 from being irremovably wedged into engagement with the teeth 54, 56 on the wall 22 of the chamber 20. In this manner, the teeth 34 on the rotor 32 are in driving engagement with the first tooth 54 on the wall 22 of the chamber 20 in the head 14 of the wrench 10 and also with the non-arcuate portion 61 of the wall 22 of the chamber 20.

Figure 14:
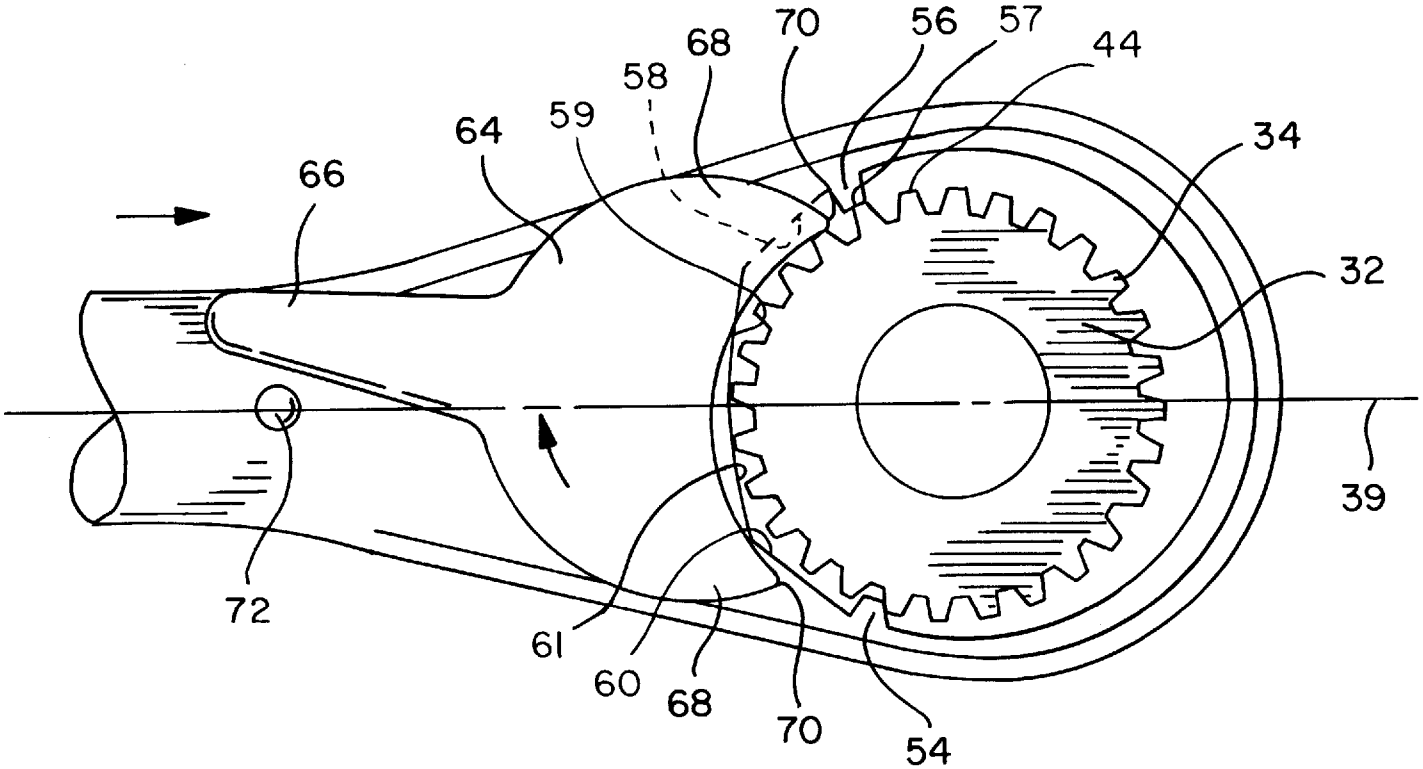
FIG. 14 is a top plan view of a third embodiment of the wrench of the present invention showing the teeth on the rotor engaging one tooth on the wall of the chamber and one embodiment of a blocking means having the lever pivoted in a first direction.

In the one embodiment of the blocking means 64, the stem 66, serving as a shifting means or lever on the blocking means 64, is moved in a first selected position wherein the end 70 of one of the arms 68 blocks or abuts teeth on the rotor 32 near the second abutted tooth 56 on the wall of the chamber 20 (FIG. 14). The abutted teeth 34 on the rotor 32 are disposed between the teeth on the chamber wall and opposite one of the non-arcuate portions 58 on the chamber wall 22. The blocking means 64 is retained in the first selected position by the biasing means 72. The blocking means 64, in this manner, assists in maintaining the rotor 32 in driving engagement by preventing the second tooth 56 on the wall 22 of the chamber 20 from being engaged between teeth 34 on the rotor 32.

Figure 15:
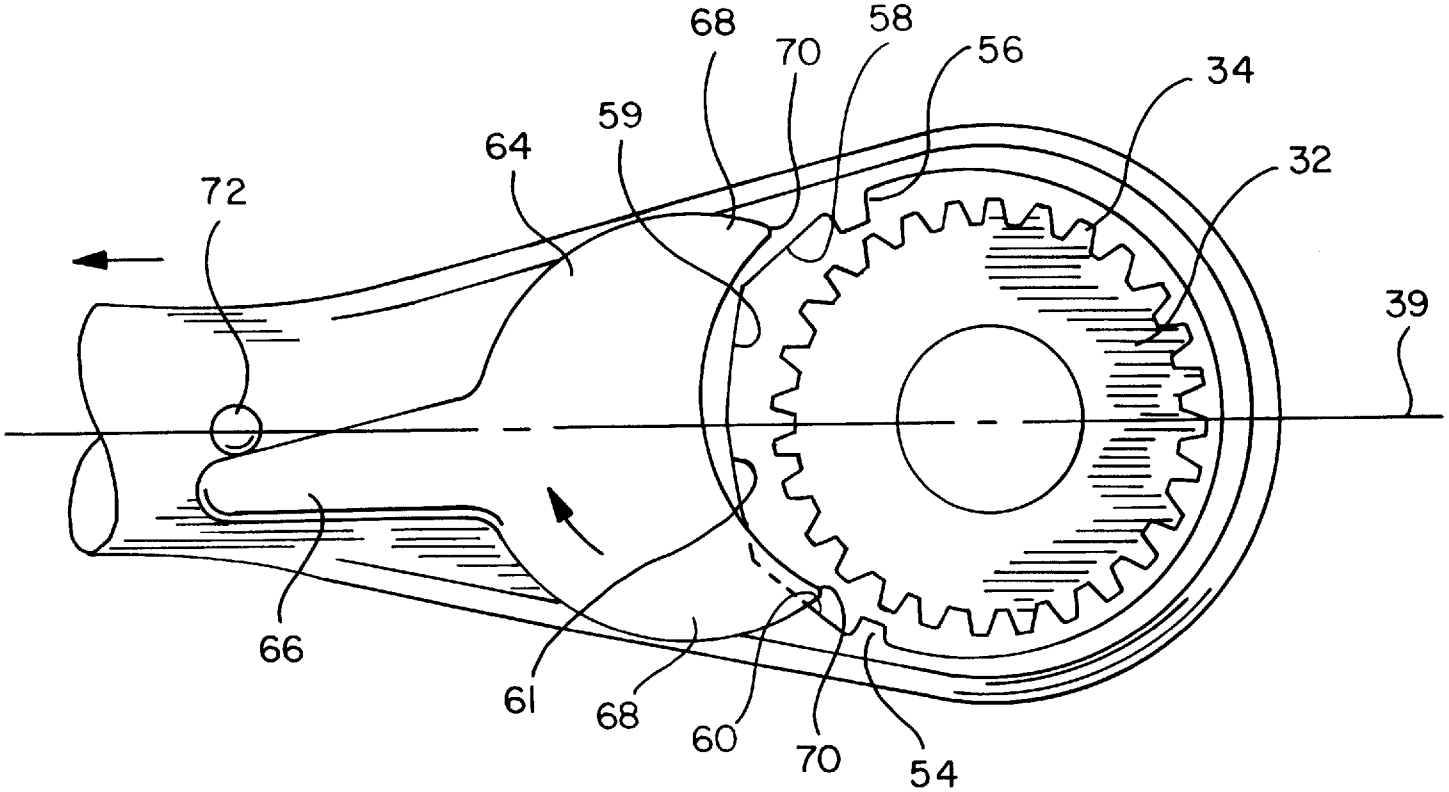
FIG. 15 is a top plan view of the embodiment of FIG. 14 showing the handle moved longitudinally to disengage the rotor from the teeth.

The handle 12 is moved laterally in a first rotational direction wherein torque is transmitted through the engaged and abutted teeth to the rotor, the tang on the rotor, the accessory and to the workpiece. The handle 12 is moved laterally to the maximum extent and is then backswung in a second opposite rotational direction and simultaneously in a second opposite longitudinal direction. The head 14 translates with respect to the rotor 32 in the larger chamber 20 and the teeth on the rotor disengage from the first tooth 54 in the chamber and there is no longer abutting contact between the teeth on the rotor 32 and the walls of the chamber nor the second tooth 56 (FIG. 15). The handle 12 is then moved in the first longitudinal direction to re-engage the teeth on the rotor 32 with the first tooth 54 in the chamber and to again abut the teeth 34 on the rotor 32 with the second tooth 56 and the arcuate portion 59, 61 of the chamber. This sequence is repeated in a ratcheting manner.

Figure 16:
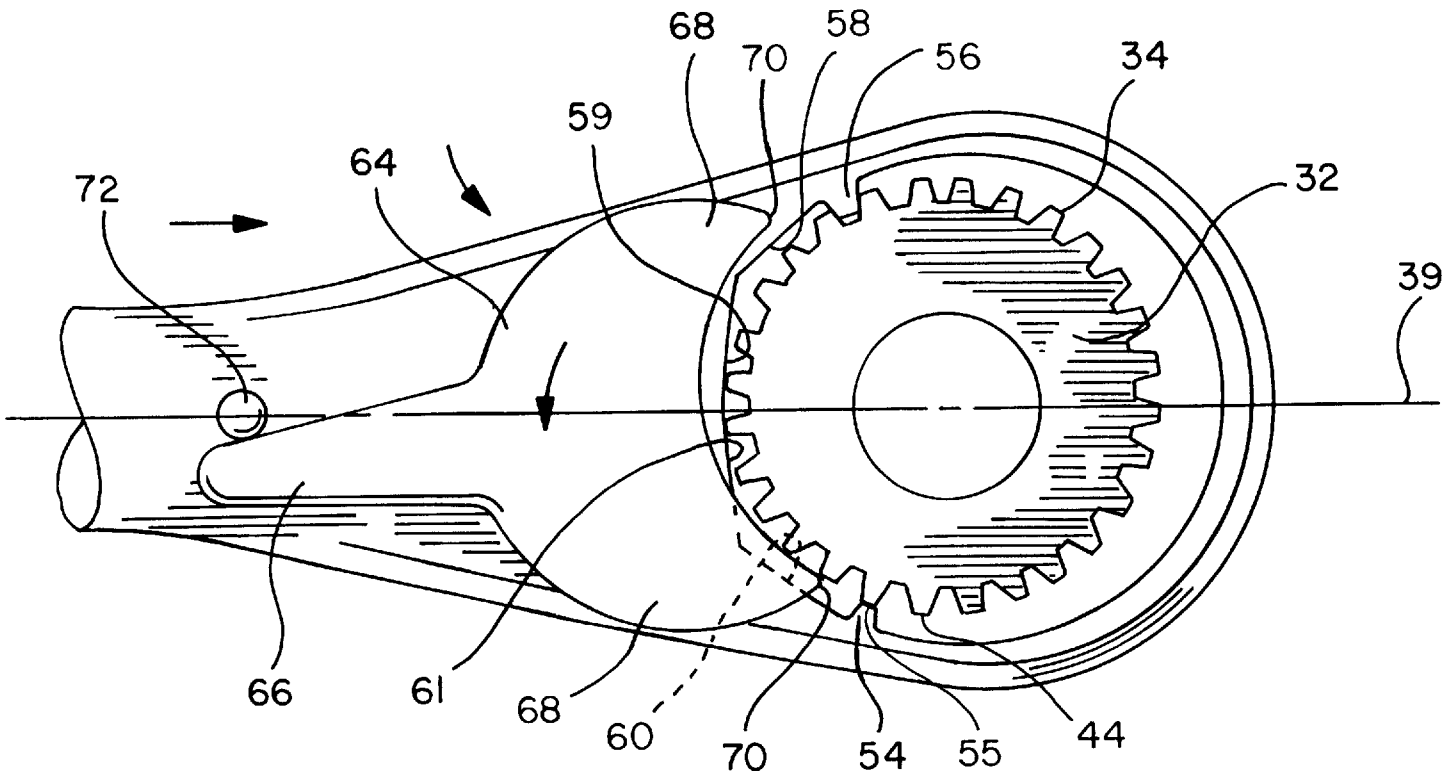
FIG. 16 is a top plan view of the embodiment of FIG. 14 with the rotor engaging a second tooth on the wall of the chamber and the lever pivoted in a second direction.

In order to apply torque to the workpiece in a second opposite direction, the handle 12 is moved in the first longitudinal direction to engage the second tooth 56 in the chamber 20 with corresponding teeth 34 on the rotor 32 (FIG. 16). The land 55 on the first tooth 54 in the chamber 20 abuts the top land 44 of corresponding teeth on the rotor 32. At least one tooth 34 on the rotor 32 abuts one of the arcuate portions 59, 61 of the chamber near the second tooth 56. The stem 66 of the blocking means 64 is moved to a second selected position wherein the end 70 of the other arm 68 blocks or abuts teeth on the rotor 32 near the first abutted tooth 54 in the chamber 20. The handle 12 is moved laterally in the second rotational direction whereby torque is applied through the teeth, the rotor, the accessory and the tang to the workpiece. The handle 12 is moved laterally to the maximum possible extent and is backswung in the first rotational direction and in the second longitudinal direction, thereby disengaging the rotor from the tooth and the abutment with the wall 22 of the chamber 20. The handle 12 is again moved in the first longitudinal direction as before and the steps are repeated in a ratcheting manner.

The second embodiment of the blocking means 64' is used similarly to the above-described blocking means 64 in that the blocking means 64' is manually moved to a selected position such that engagement of the teeth on the rotor 32 with a selected one of the teeth 54, 56 on the wall 22 of the chamber 20 is allowed and to prevent the other tooth on the wall of the chamber 20 from being engaged with the teeth on the rotor 32. Before the handle 12 is moved to engage a selected tooth on the wall of the chamber 20 with teeth 34 on the rotor 32, the lever 80 on the blocking means 64' is moved to the selected position so that the protrusion 88 is received in the notch 86. Preferably a single protrusion 88 is formed along the center line of the head 14 but alternately, two or more protrusions 88 may be formed, the protrusions being on opposite sides of the wall 22 of the chamber 20, in the portion of the chamber opposite from the handle. One of the ends 82 of the sleeve member 78 is thereby disposed immediately adjacent to, and blocking or abutting, the surface edge of one of the teeth 54, 56 on the wall 22 of the chamber 20 such that movement of the head with respect to the rotor 32 is prevented and the engagement of teeth on the rotor 32 with the selected tooth on the wall of the chamber 20 is positively reinforced while engagement of teeth on the rotor 32 with the teeth on the wall opposite from the selected teeth, is prevented.

Figure 20:
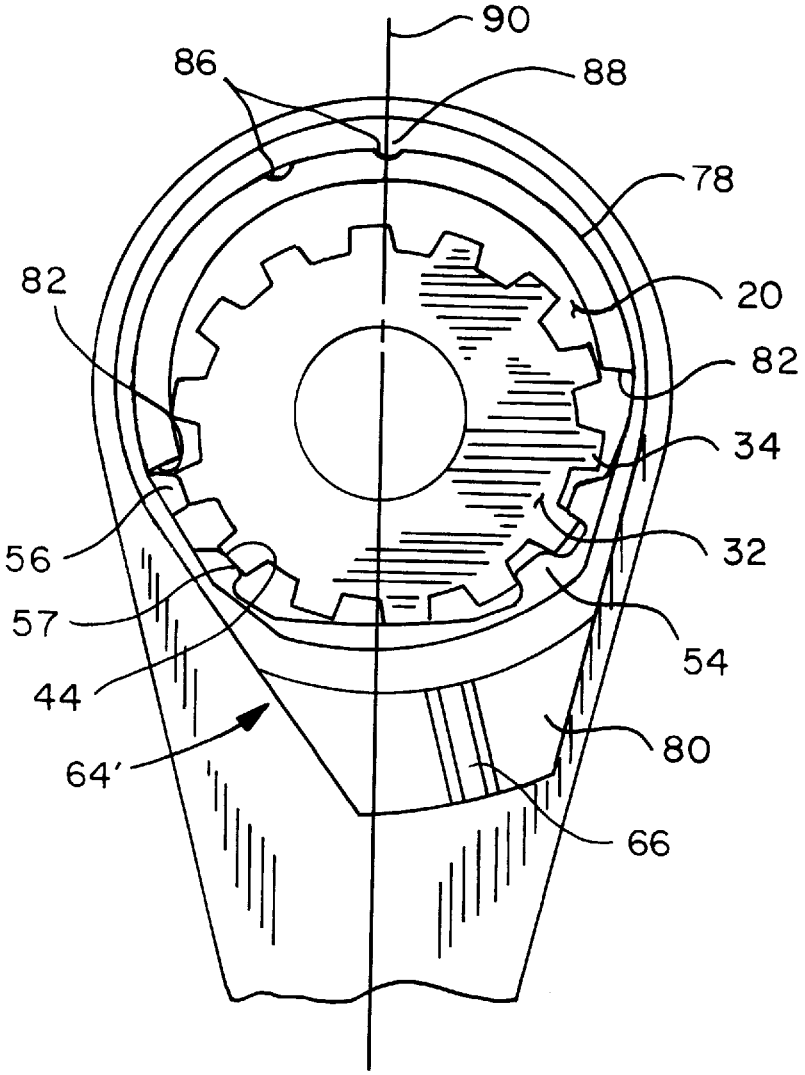
FIG. 20 is a top plan view of the third embodiment of the wrench of the present invention showing the teeth on the rotor engaging two teeth on the wall of the chamber and a second embodiment of a blocking means having the blocking means moved in a first direction.
Figure 21:
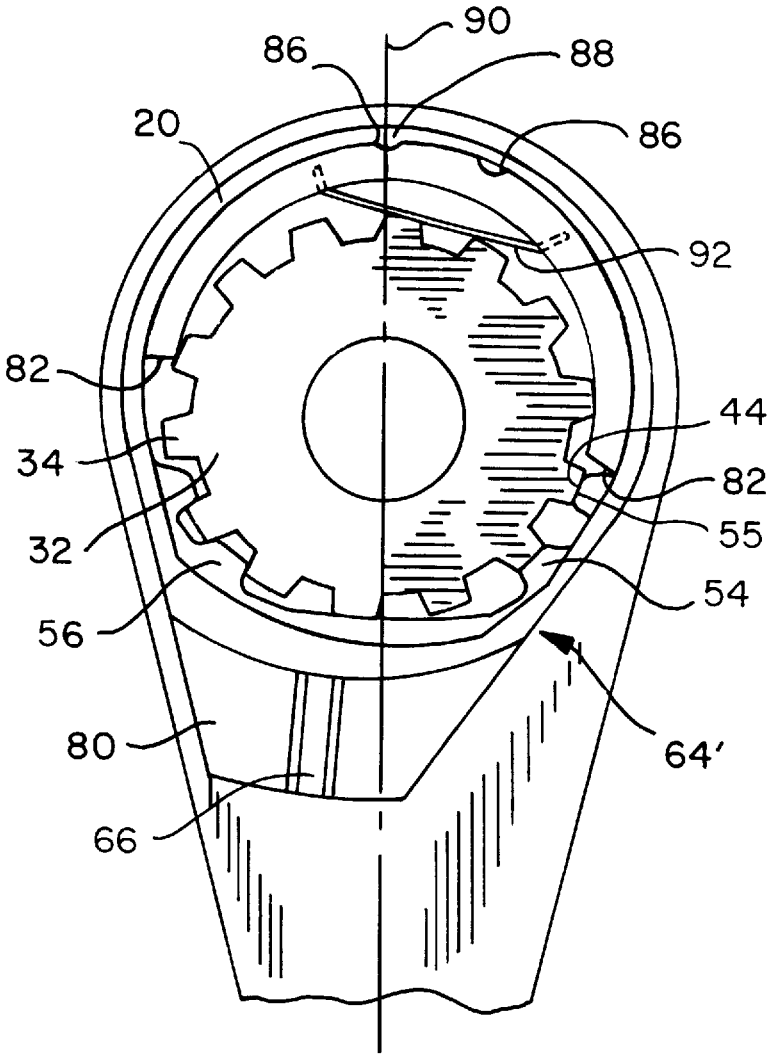
FIG. 21 is a top plan view of the embodiment of FIG. 20 showing the blocking means moved in a second direction and having a spring in the blocking means.

The movement of the blocking means 64' to a first selected position is shown in FIG. 20. Movement of the blocking means 64' to a second selected position is shown in FIG. 21. In either of these figures, the selected notch 86 is disposed on the center line 90 of the head 14 and the lever 80 is, consequently disposed to the right or the left of the center line. The selected tooth 54, 56 on the wall 22 of the chamber 20 is engaged by teeth on the rotor 32 and the top land 44 of other teeth on the rotor 32 abut the respective land 55, 57 of the teeth 54, 56 on the wall 22 of the chamber 20.

Figure 22:
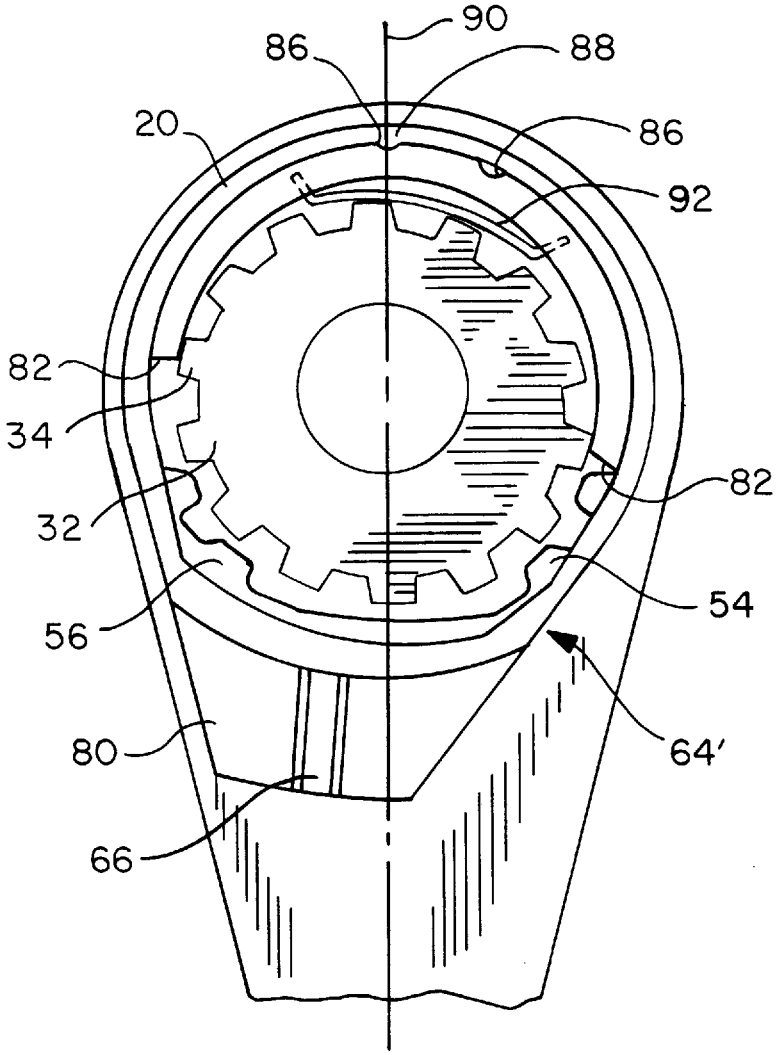
FIG. 22 is a top plan view of the embodiment of FIG. 20 showing the rotor in an intermediate position and the teeth on the rotor disengaged from the teeth on the wall of the chamber.
Figure 24:
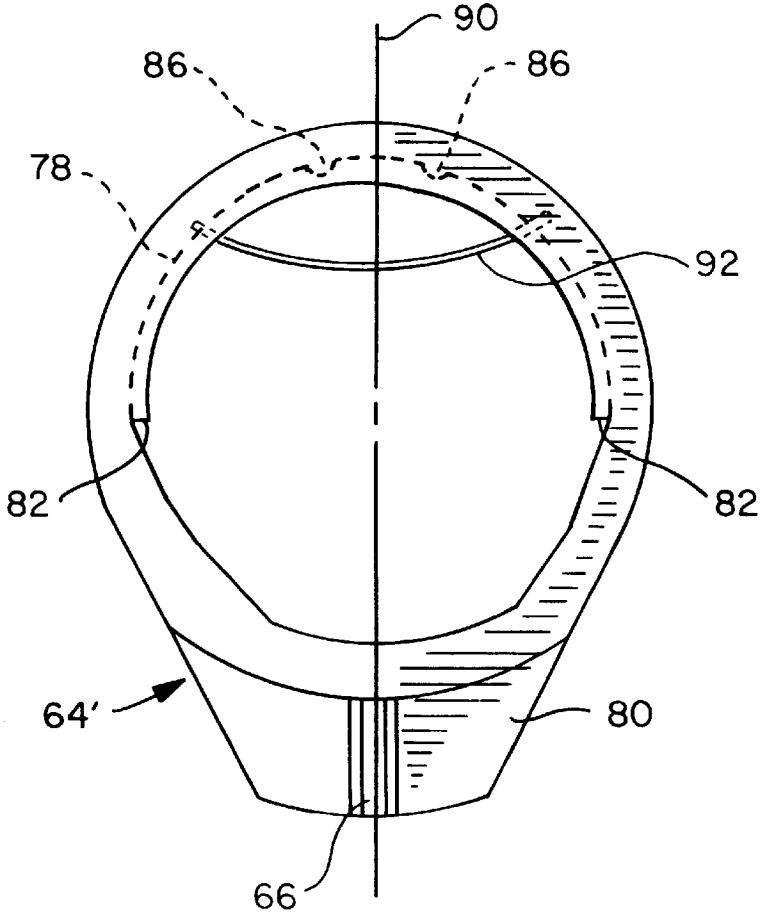
FIG. 24 is a top plan view of the blocking means of the embodiment of FIG. 21.
Figure 23:
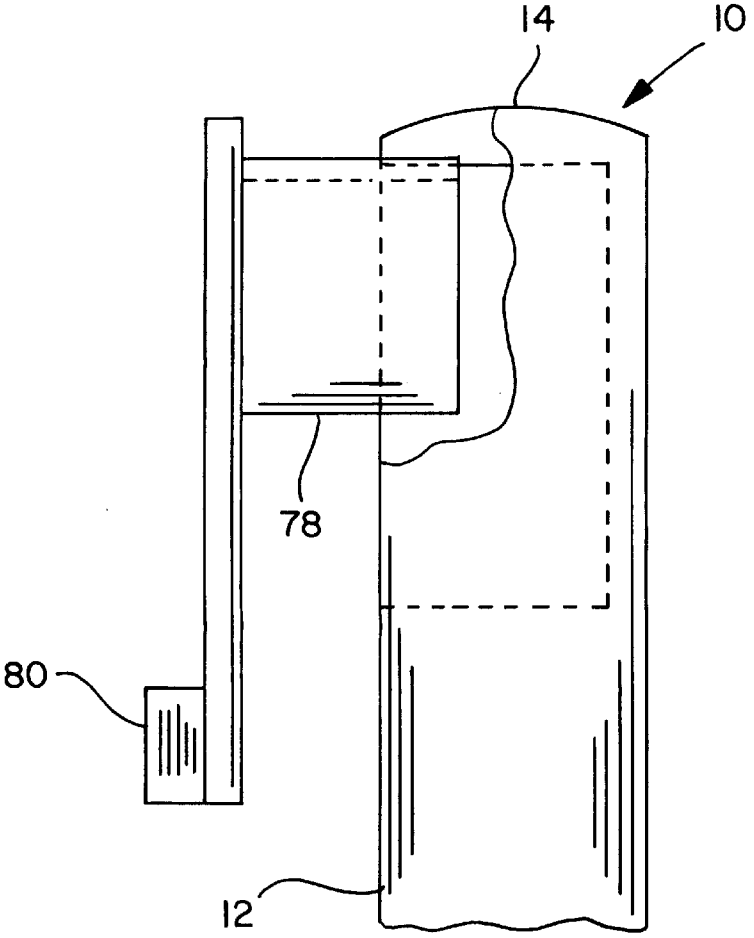
FIG. 23 is a side elevation view in partial cut-away of the embodiment of FIG. 20.
Figure 25:
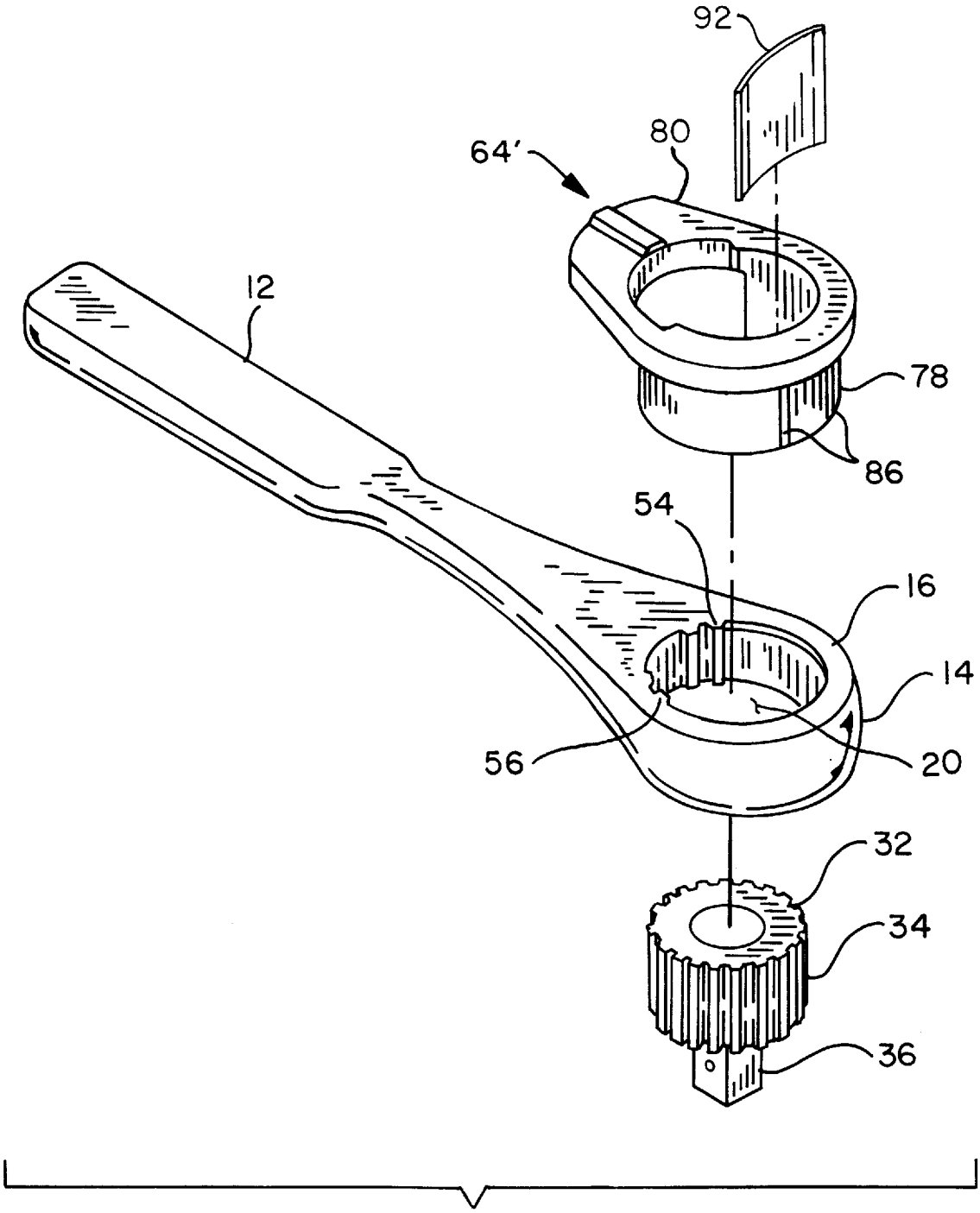
FIG. 25 is an exploded perspective view of the wrench of the embodiment of FIG. 21.

In a further embodiment of the wrench, a resilient means 92, such as a leaf spring, is disposed in the chamber 20 between the rotor 32 and the wall 22 of the chamber 20. The resilient means urges the rotor in a direction toward the handle 12 such that selected teeth 34 on the rotor 32 are in engagement with a corresponding selected tooth 54,56 on the wall of the chamber and another tooth (or teeth) on the rotor 32 are abutting the other tooth (or teeth) on the wall of the chamber (FIG. 21). In a preferred embodiment as shown in FIGS. 21 and 22, the resilient means 92 is connected to the blocking means 64' and is movable within the chamber 20. When the blocking means 64' is rotated, the resilient means 92 urges the rotor 32 to engage with the selected tooth 54, 56 on the wall 22 of the chamber 20. The blocking means 64, 64' may be used in conjunction with the resilient means 92 or may be omitted from the wrench 10.

This further embodiment is used by moving the handle 12 laterally toward the workpiece and engaging a selected tooth 26 on the wall of the chamber with abutment of the other tooth on the wall of the chamber by teeth on the rotor 32. The handle 12 is rotated laterally in the first direction to transmit torque through the rotor, the accessory and tang to the workpiece. The handle is moved laterally to the maximum possible extent and is backswung in an opposite lateral direction. The teeth 34 on the rotor 32 disengage from teeth on the wall of the chamber and the rotor 32 compresses the resilient means 92 (FIG. 22). The handle is again rotated laterally in the first direction with the longitudinal movement of the handle being supplied by the decompression of the resilient means. The further embodiment of the wrench is used in the same manner as a conventional ratchet wrench which has a pawl.

To reverse the direction of application of torque (i.e., clockwise vs. counterclockwise) the handle is moved laterally to engage the opposite selected tooth on the wall of the chamber and the lateral rotation is in a second opposite direction. The operation otherwise is as described above.

Figure 17:
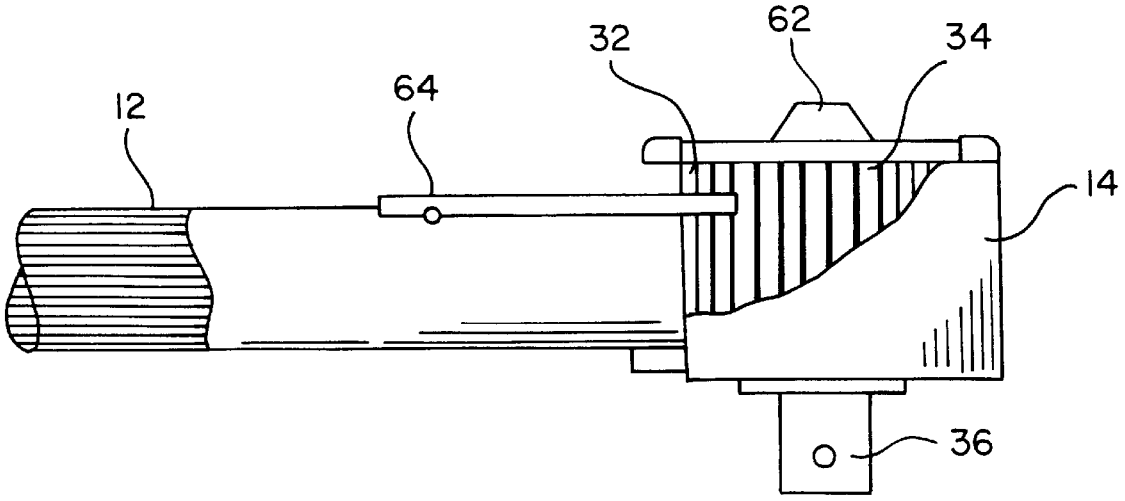
FIG. 17 is a side elevation view in partial cut-away of the embodiment of FIG. 14 showing one alternative of the blocking means engaging the rotor.
Figure 18:
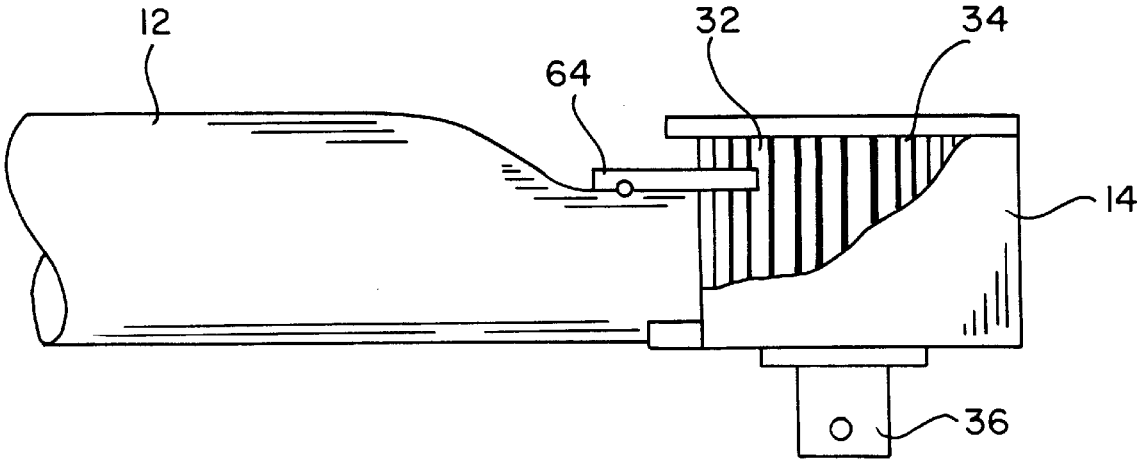
FIG. 18 is a side elevation view in partial cut-away of the embodiment of FIG. 14 showing another alternate disposition of the blocking means engaging the rotor.
Figure 19:
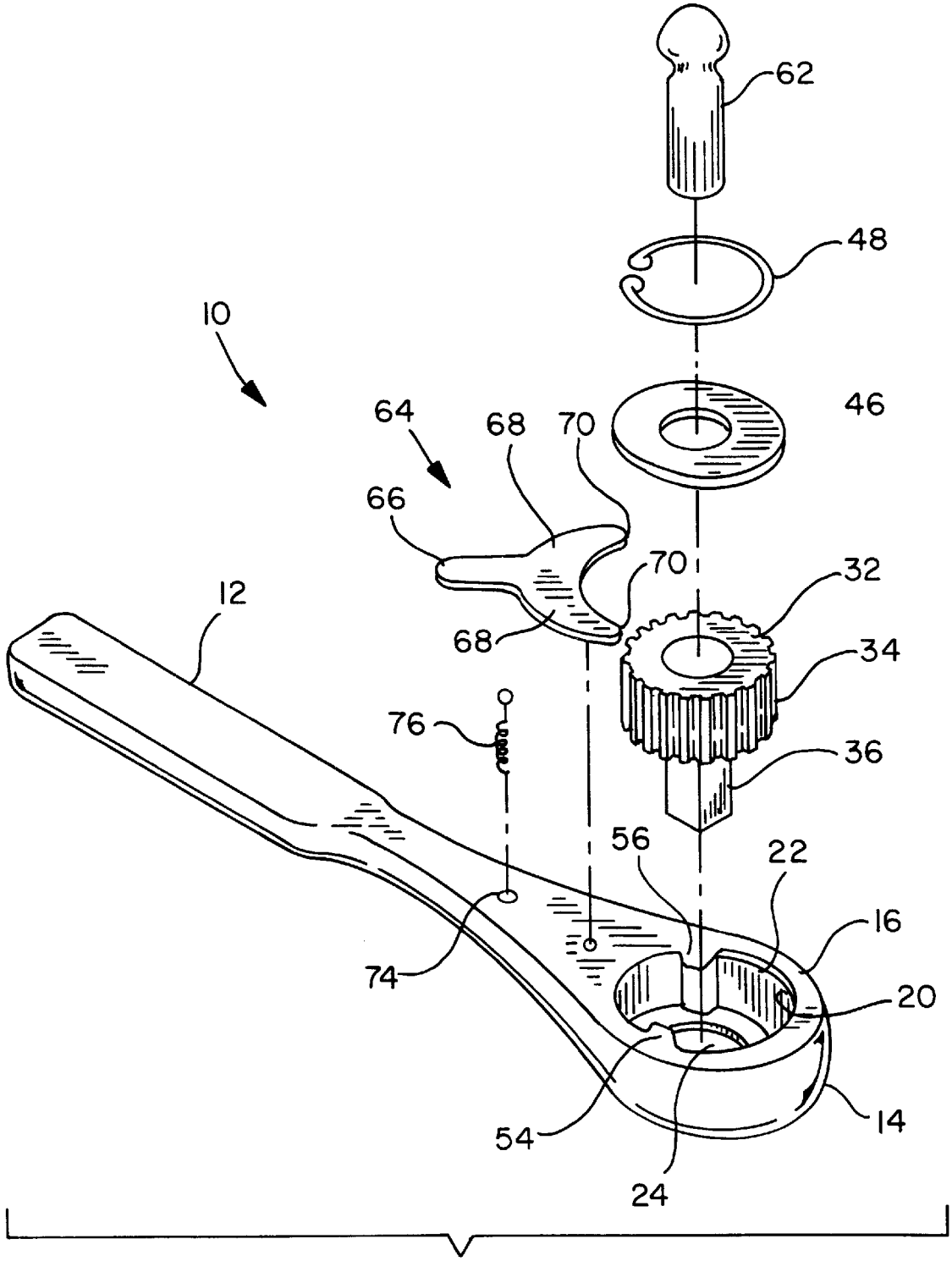
FIG. 19 is an exploded perspective view of the embodiment of FIG. 14.

The handle 12 and head 14 of the wrench 10 of any of the three embodiments may be formed as an integral unit by casting, molding or machining or alternately may be formed from a plurality of sheets laminated to form the handle and head (FIG. 17).

The ratchet wrench of the present invention provides a wrench which is economical to produce since it has fewer parts, being without a pawl, and can be produced by inexpensive manufacturing methods. Labor costs for assembly are also reduced.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A wrench comprising a handle and an integral head, the head having a top surface, a bottom surface and a chamber formed therein, the chamber having a wall thereabout, at least one tooth being formed on the wall of the chamber and projecting into the chamber, a cylindrical rotor disposed in the chamber, the rotor having a plurality of spaced-apart teeth formed axially on a circumference thereof, the rotor having means thereon to engage a workpiece, wherein the at least one tooth on the wall of chamber has a first surface having a height and a second opposite surface having a height less than the first surface, the first surface of the at least one tooth on the wall of the chamber engaging one of the teeth on the rotor, the chamber in the head having a cross-sectional area and the rotor having a smaller cross-sectional area, wherein the rotor is translatably and eccentrically moveable within the chamber in the head, such that movement of the handle in a first direction engages the at least one tooth on the wall of the chamber with one of the teeth on the rotor, and transmits torque to the rotor and the means to engage the workpiece, and movement of the handle in a second opposite direction disengages the teeth and moves the rotor from the engagement with the at least one tooth on the chamber wall.

2. The wrench of claim 1, wherein the means on the rotor to engage a workpiece are accessible from the top surface and the bottom surface of the head.

3. The wrench of claim 1, wherein all the teeth on the rotor are spaced apart by an equal distance, the distance between the teeth on the rotor being greater than a height of the first surface of the at least one tooth on the wall of the chamber.

4. The wrench of claim 1, wherein the chamber in the head is noncircular.

5. The wrench of claim 4, wherein the wall of the chamber in the head has a flat portion formed therein and spaced apart from the at least one tooth on the wall of the chamber.

6. The wrench of claim 1, further comprising the chamber having an opening communicating with the bottom surface of the head, wherein the means on the rotor to engage the workpiece are two tangs formed on the rotor, one tang extending outwardly from the top surface of the head and the other tang diametrically opposed thereto and extending outwardly through the opening and from the bottom surface of the head.

7. The wrench of claim 1, wherein the means on the rotor to engage the workpiece is an opening formed in the center of the rotor.

8. The wrench of claim 1, wherein the handle and the head are formed from a plurality of sheets laminated together.

9. A wrench comprising a handle and an integral head, the head having a top surface, a bottom surface and a noncircular chamber formed therein, the chamber having a wall thereabout, at least one tooth being formed on the wall of the chamber and projecting into the chamber, a cylindrical rotor disposed in the chamber, the rotor having a plurality of spaced-apart teeth formed axially on a circumference thereof, the rotor having means thereon to engage a workpiece, wherein the wall of the chamber in the head has a flat portion formed therein and spaced apart from the at least one tooth on the wall of the chamber, each tooth on the rotor having a top land, wherein, when the at least one tooth on the wall of the chamber engages one of the teeth on the rotor, the top land of another of the teeth on the rotor is in contact with the flat portion on the wall of the chamber thereby maintaining engagement between the at least one tooth on the wall of the chamber and the one tooth on the rotor, the chamber in the head having a cross-sectional area and the rotor having a smaller cross-sectional area, wherein the rotor is translatably and eccentrically moveable within the chamber in the head, such that movement of the handle in a first direction engages the at least one tooth on the wall of the chamber with one of the teeth on the rotor, and transmits torque to the rotor and the means to engage the workpiece, and movement of the handle in a second opposite direction disengages the teeth and moves the rotor from the engagement with the at least one tooth on the chamber wall.

10. A wrench comprising a handle and an integral head, the head having a top surface, a bottom surface and a chamber formed therein, the chamber having a wall thereabout, at least one tooth being formed on the wall of the chamber and projecting into the chamber, a cylindrical rotor disposed in the chamber, the rotor having a plurality of spaced-apart teeth formed axially on a circumference thereof, the rotor having means thereon to engage a workpiece, wherein each tooth on the rotor has a top land and a first surface, the first surfaces of each of the teeth on the rotor having an equal height, the at least one tooth on the wall of the chamber has a first surface having a height greater than the height of the respective surface of the teeth on the rotor, wherein when the at least one tooth on the wall of the chamber engages the tooth on the rotor, the top land of the tooth on the rotor avoids contact with the wall of the chamber, the chamber in the head having a cross-sectional area and the rotor having a smaller cross-sectional area, wherein the rotor is translatably and eccentrically moveable within the chamber in the head, such that movement of the handle in a first direction engages the at least one tooth on the wall of the chamber with one of the teeth on the rotor, and transmits torque to the rotor and the means to engage the workpiece, and movement of the handle in a second opposite direction disengages the teeth and moves the rotor from the engagement with the at least one tooth on the chamber wall.

11. A wrench comprising a handle and an integral head, the head having a chamber formed therein, the chamber having a wall thereabout, a first set of teeth formed on the wall of the chamber and projecting into the chamber, a second set of teeth formed on the wall of the chamber and spaced apart from the first set of teeth, the second set of teeth projecting into the chamber, a cylindrical rotor disposed in the chamber, the rotor having a plurality of spaced-apart teeth formed axially on a circumference thereof, a workpiece engagement means formed on the rotor, the chamber in the head having a cross-sectional area and the rotor having a smaller cross-sectional area, wherein the rotor is translatably and eccentrically moveable within the chamber in the head, wherein movement of the handle engages one of the sets of teeth on the chamber wall with corresponding teeth on the rotor and abuts the other set of teeth on the chamber wall with corresponding teeth on the rotor such that the teeth on the rotor are in driving engagement with the teeth on the wall of the chamber, and wherein reverse movement of the handle moves the head with respect to the rotor, disengaging the teeth on the rotor from the one set of teeth on the chamber wall in the head.

12. The wrench of claim 11, wherein the respective teeth in each set are equidistant from each other.

13. The wrench of claim 11, wherein the first set of teeth and the second set of teeth in the chamber are opposite from one another and are distal from the handle.

14. The wrench of claim 11, wherein the first set of teeth and the second set of teeth in the chamber are opposite from one another and are proximal to the handle.

15. The wrench of claim 11, wherein the chamber in the head is non-circular.

16. The wrench of claim 15, wherein the chamber in the head has a length and a width perpendicular thereto, the length of the chamber being greater than the width.

17. The wrench of claim 11, further comprising means to retain the rotor in the chamber.

18. The wrench of claim 11, wherein the handle and the head are formed from a plurality of sheets laminated together.

19. A wrench comprising a handle and an integral head, the head having a chamber formed therein, the chamber having a wall thereabout, the wall having a height, at least a first tooth formed on the wall of the chamber and projecting into the chamber, at least a second tooth formed on the wall of the chamber and spaced apart from the at least a first tooth, the at least a second tooth projecting into the chamber, a cylindrical rotor disposed in the chamber, the rotor having a plurality of spaced-apart teeth formed axially on a circumference thereof, a workpiece engaging means formed on the rotor, the chamber in the head having a cross-sectional area and the rotor having a smaller cross-sectional area, wherein the rotor is translatably and eccentrically moveable within the chamber in the head, blocking means movably attached to the head, wherein, when the head is moved with respect to the rotor such that selected teeth on the rotor are in driving engagement with a selected at least one tooth on the wall of the chamber, the at least one spaced-apart tooth on the wall of the chamber abuts a corresponding tooth on the rotor, and movement of the blocking means to a selected position moves the blocking means to a position adjacent to the abutted at least one tooth on the wall of the chamber, thereby preventing the abutted at least one tooth on the wall of the chamber from becoming engaged with the teeth on the rotor.

20. The wrench of claim 19, wherein the blocking means has a center stem, a pair of spaced-apart arms connected to the center stem, each arm having a respective end, the center stem serving as a lever such that movement of the lever moves a selected one of the arms to the selected position to abut at least one of the teeth on the rotor.

21. The wrench of claim 20, wherein a blind bore is formed near the chamber in the head, a detent means being disposed in the blind bore, the detent means being urged against the center stem of the blocking means to retain the blocking means in the selected position.

22. The wrench of claim 19, wherein the blocking means comprises a sleeve member disposed peripherally adjacent to the wall of the chamber distal from the handle, the sleeve member being connected to a shifting means to permit rotational movement of the sleeve member, the sleeve member having opposite ends, such that movement of the shifting means moves a selected end of the sleeve member to block the at least one spaced-apart tooth on the wall of the chamber, the opposite edge of the sleeve being clear of the selected at least one tooth on the wall of the chamber.

23. The wrench of claim 22, wherein a protrusion is formed on the wall of the chamber distal from the handle, a pair of spaced-apart notches being formed in the sleeve distal from the handle, wherein movement of the sleeve engages the protrusion in a selected notch, retaining the sleeve in the selected position.

24. The wrench of claim 19, wherein the chamber in the head is non-circular.

25. The wrench of claim 24, wherein the chamber in the head has a length and a width perpendicular thereto, the length being greater than the width.

26. The wrench of claim 19, wherein the wall of the chamber proximal to the handle and between the teeth on the wall of the chamber has at least one arcuate portion formed thereon.

27. The wrench of claim 26, wherein one of the teeth on the rotor abuts the at least one arcuate portion of the wall of the chamber when the rotor is in locked driving engagement with the head of the wrench, thereby preventing wedging and non-removability of the rotor within the chamber.

28. The wrench of claim 19, wherein the at least a first tooth and the at least a second tooth on the wall of the chamber each has a respective equal first height and each tooth on the rotor has an equal second height, the respective first height being greater than the second height.

29. The wrench of claim 19, wherein the rotor has an axial length and the wall of the chamber has an axial length, the length of the rotor being greater than the length of the chamber.

30. The wrench of claim 19, further comprising a resilient means disposed in the chamber between the rotor and the wall of the chamber, wherein the resilient means urges the teeth on the rotor into engagement with the selected at least one tooth on the wall of the chamber.

31. The wrench of claim 30, wherein the resilient means is connected to a movable means, thereby permitting the resilient means to urge the rotor toward the selected at least one tooth on the wall of the chamber.

32. The wrench of claim 30, wherein the resilient means is a leaf spring disposed transversely across the chamber distal from the handle.

33. A wrench comprising a handle and an integral head, the head having a chamber formed therein, the chamber having a wall thereabout, the wall having a height, at least a first tooth formed on the wall of the chamber and projecting into the chamber, at least a second tooth formed on the wall of the chamber and spaced apart from the at least a first tooth, the at least a second tooth projecting into the chamber, a cylindrical rotor disposed in the chamber, the rotor having a plurality of spaced-apart teeth formed axially on a circumference thereof, a workpiece engaging means formed on the rotor, the chamber in the head having a cross-sectional area and the rotor having a smaller cross-sectional area, wherein the rotor is translatably and eccentrically moveable within the chamber in the head, a resilient means disposed in the chamber between the rotor and the wall of the chamber, wherein the resilient means urges the teeth on the rotor into engagement with a selected at least one tooth on the wall of the chamber, wherein, when the head is moved with respect to the rotor such that selected teeth on the rotor are engaged with the selected at least one tooth on the wall of the chamber, the at least one spaced-apart tooth on the wall of the chamber abuts a corresponding tooth on the rotor.

34. The wrench of claim 33, wherein the resilient means is a leaf spring disposed transversely across the chamber distal from the handle.

35. The wrench of claim 1, wherein all the teeth on the rotor are spaced apart by an equal distance, the distance between the teeth on the rotor being greater than a height of the surfaces of the teeth on the rotor.

* * * * *